US005160252A

United States Patent [19]

Edwards

[11] Patent Number: 5,160,252

[45] Date of Patent: Nov. 3, 1992

[54] ROTARY VANE MACHINES WITH ANTI-FRICTION POSITIVE BI-AXIAL VANE MOTION CONTROLS

[76] Inventor: Thomas C. Edwards, 1426 Gleneagles Way, Rockledge, Fla. 32955

[21] Appl. No.: 718,560

[22] Filed: Jun. 20, 1991

Related U.S. Application Data

[63] Continuation-in-part of Ser. No. 534,542, Jun. 7, 1990.

[51] Int. Cl.[5] ..... F04C 2/344

[52] U.S. Cl. ..... 418/1; 418/150; 418/260; 418/264; 418/265; 418/270; 418/DIG. 1

[58] Field of Search ..... 418/260, 265, 264, 270, 418/1, 261, 262, 150

[56] References Cited

U.S. PATENT DOCUMENTS

| | | | |
|---|---|---|---|
| 502,890 | 8/1893 | Reickhelm . | |
| 599,778 | 3/1898 | Funk . | |
| 949,431 | 2/1910 | Hokanson . | |
| 999,573 | 6/1911 | Cotoli . | |
| 1,042,596 | 10/1912 | Pearson . | |
| 1,291,618 | 1/1919 | Olson | 418/265 |
| 1,336,843 | 4/1920 | Kutchka . | |
| 1,339,123 | 5/1920 | Smith . | |
| 1,549,515 | 8/1925 | Smith . | |
| 1,669,779 | 5/1928 | Reavell | 418/265 |
| 1,833,275 | 11/1931 | Burmeister . | |
| 2,003,615 | 6/1935 | Smith et al. | 418/265 |
| 2,179,401 | 11/1939 | Chkliar . | |
| 2,346,561 | 4/1944 | Allen, Jr. . | |
| 2,443,994 | 6/1948 | Scognamillo | 418/265 |

(List continued on next page.)

*Primary Examiner*—Richard A. Bertsch
*Assistant Examiner*—David L. Cavanaugh
*Attorney, Agent, or Firm*—Evenson, Wands, Edwards, Lenahan & McKeown

[57] ABSTRACT

A fluid displacement machine of the vane type which can be operated as a compressor or motor utilizes a cylindrical rotor equipped with one or more tethered sliding vanes wherein the rotor and vane set is rotatably located eccentrically inside an internal conforming casing profile between opposing endplates to define enclosed variable volume compartments. [Each vane is fitted on opposite sides eith tethers which are pivotally-mounted remotely from the vane tips. The tethers engage, through anti-friction means, circular annuli located within the endplates which are eccentric with the hollow casing profile.] Anti-friction tether-to-annuli means are used, one in the form of freely-rotating caged roller bearings interposed between the tethers and the respective internal annuli, and another in the form of tethers equipped with trunnioned bearings which directly engage these internal annular surfaces. [Combinations of these anti-friction vane tethering means are also disclosed, including a compressor with a twin roller tether arrangement and one with a variable speed roller bearing retainer. The vane tethers engage both internal peripheries of the endplate annuli for the purpose of providing positive bi-axial radial vane motion control, and the profile of the casing is defined such that the tips of the positive motion-controlled vanes remain in an exceedingly close yet substantially frictionless sealing relationship with the conforming hollow casing.] A circular casing interior profile is achieved by placing the center of the vane tip radius at the exact coincidence with the glider axle center and making the tip radius equal to the difference in the radii of the stator and the radius of the path of the glider axle centerline less the rotor offset from the stator center. A compressor can be provided with an oil separator in the discharge line or with a discharge valve to reduce noise and increase operating efficiency over a larger temperature range. Alternatively, a volunteer oiling system can be employed to circulate lubricant continuously. For lower costs machines, low friction sliding surfaces can be ussed in lieu of the ball bearings or a semi-lubricated ring can be substituted to provide a permanent lubricant change.

41 Claims, 24 Drawing Sheets

U.S. PATENT DOCUMENTS

| | | | |
|---|---|---|---|
| 2,465,887 | 3/1949 | Larsh | 418/265 |
| 2,469,510 | 5/1949 | Martinmaas | 418/265 |
| 2,672,282 | 3/1954 | Novas | 418/265 |
| 2,781,729 | 2/1957 | Johnson et al. . | |
| 3,053,438 | 9/1962 | Meyer . | |
| 3,101,076 | 8/1963 | Stephens-Castaneda | 418/265 |
| 3,464,395 | 9/1969 | Kelly . | |
| 3,568,615 | 3/1971 | Grimm . | |
| 3,904,237 | 9/1975 | Edwards et al. . | |
| 3,952,709 | 4/1976 | Riddel . | |
| 4,005,951 | 2/1977 | Swinkels . | |
| 4,184,821 | 1/1980 | Smolinski et al. . | |
| 4,212,603 | 7/1980 | Smolinski | 418/265 |
| 4,247,268 | 1/1981 | Banolas de Ayala . | |
| 4,299,047 | 11/1981 | Shank et al. | 418/159 |
| 4,410,305 | 10/1983 | Shank et al. | 418/264 |
| 4,705,465 | 11/1987 | Su | 418/264 |
| 4,958,995 | 9/1990 | Sakamaki et al. | 418/265 |

FIG 4c
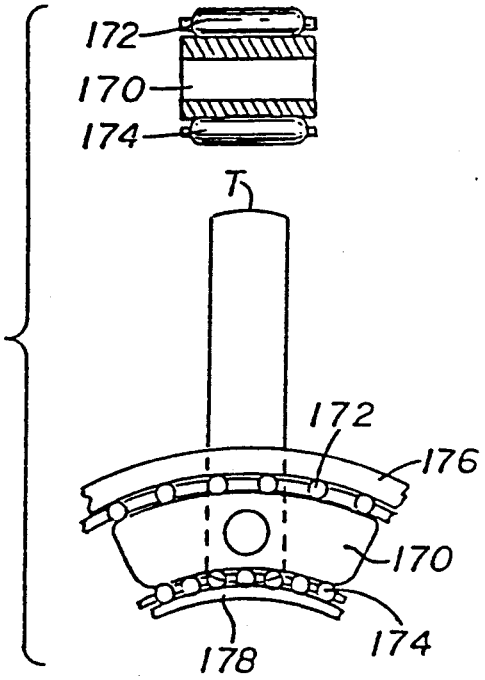
FIG 4d
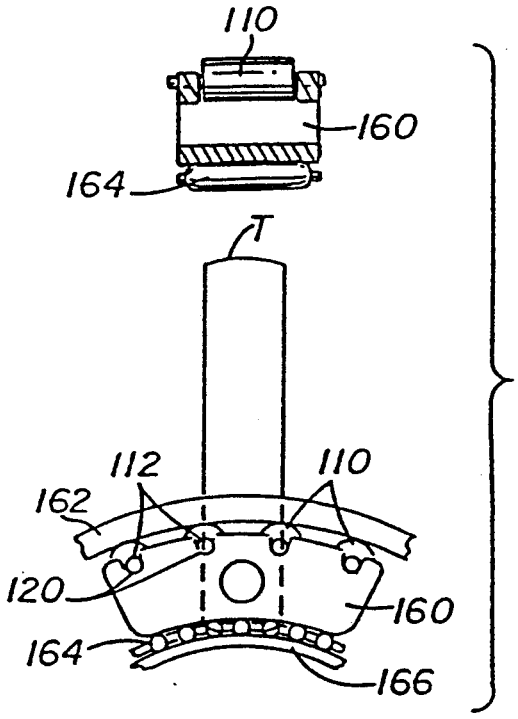
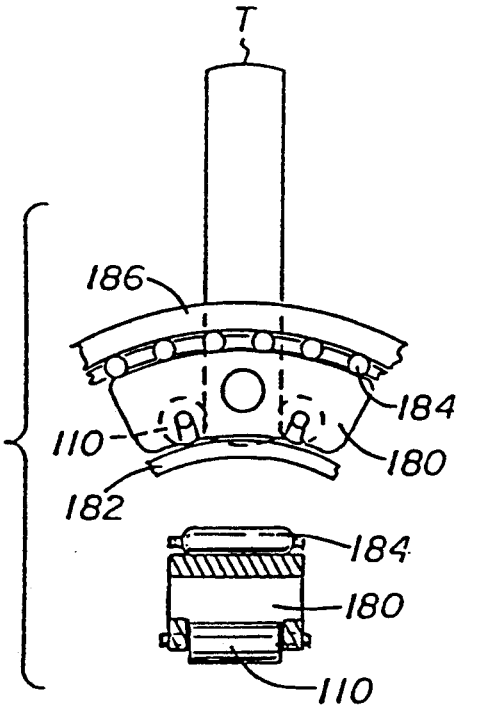
FIG 4e
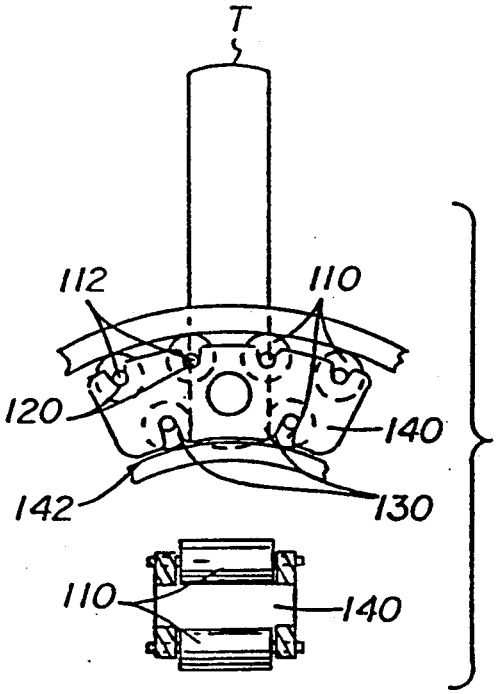
FIG 4f

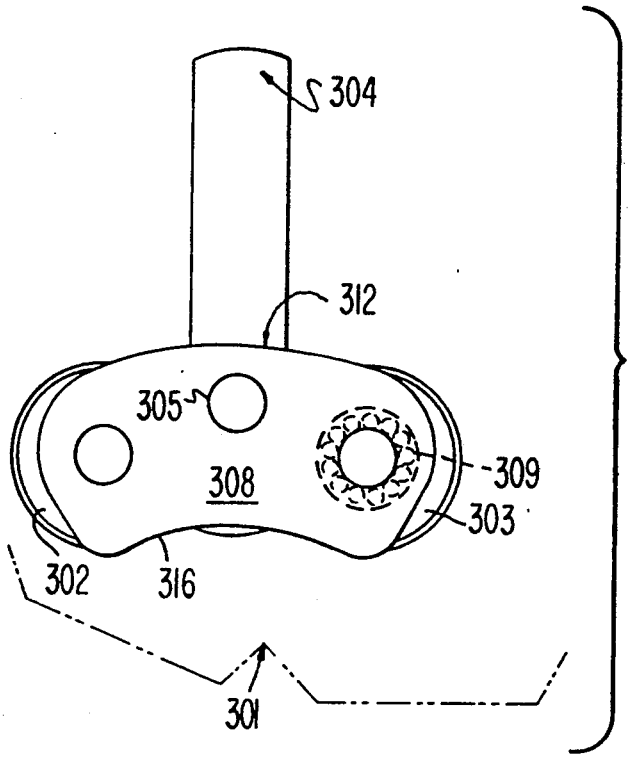
FIG. 6F
FIG. 6G(1)
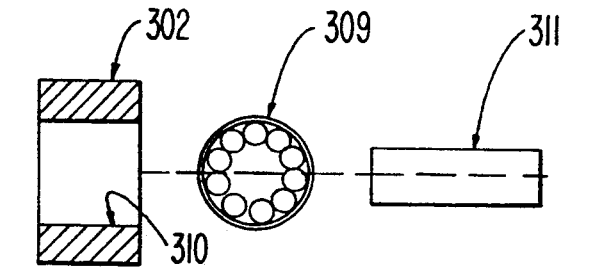
FIG. 6G(2)
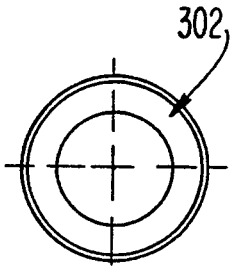
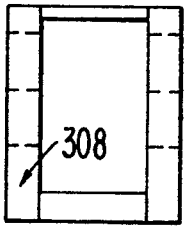
FIG. 6G(3)
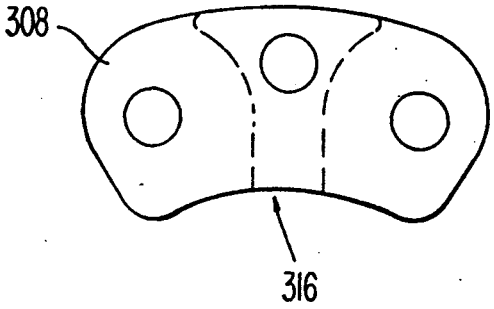
FIG. 6G(4)

ROTARY VANE MACHINES WITH ANTI-FRICTION POSITIVE BI-AXIAL VANE MOTION CONTROLS

CROSS REFERENCE TO RELATED APPLICATION

This application is a continuation-in-part of application Ser. No. 07/534,542 filed June 7, 1990.

BACKGROUND AND SUMMARY OF INVENTION

The present invention relates to guided rotary sliding vane machinery, such as compressors, in which the radial motion of the vanes is controlled to obtain non-contact sealing between the vane tips and the interior stator casing sidewall as a result of the cooperation of opposing vane extensions that engage cooperative circular radial guides that are located on both ends of the machine.

Conventional and elementary sliding rotary vane machines are, on one hand, distinguished from virtually all other fluid displacement machines in their remarkable simplicity. On the other hand, such machines exhibit relatively poor operating efficiency. This poor energy efficiency is rooted directly in machine friction, both mechanical and gas dynamic. As is well known, the predominant source of mechanical friction in conventional production contact vane rotary machines occurs at the intense rubbing interface of the tip of the sliding vane and inner contour of the stator wall. Furthermore, governing the motion of the vane by the stator wall contour necessarily and greatly inhibits the area through which gas can enter or exit the machine because ports in the stator housing diminish the vane tip contact area that is already at a premium in such machines. Minimizing flow part area in favor of vane tip contact area results in increased fluid flow pressure losses in the inlet and outlet port regions of such type machines.

Over the years, many means have been proposed to eliminate guiding the radial motion of the vanes through the direct action of the vane tips rubbing along the inside casing or stator wall. In many previous endeavors to grapple with this mechanical problem, attention has been focused upon the use of wheels and rollers pinned to the sides of the vanes wherein these rollers follow inside a circular or non-circular cam track of the appropriate configuration. The cooperation of the rollers in the roller guide track then produces a means of dictating the radial location of the vane which is pinned to the roller follower and hence determines the position of the tip of the vane.

As attractive as this approach first appears to be, rollers wheels contain an overwhelming flaw. Specifically, they cannot provide positive bi-axial radial motion without having to reverse their rotational direction. Thus, vanes constrained by rollers can accommodate geometric displacement in only an outward or inward direction at any one time.

As an example, if the roller has been in contact with one side of the track, and because of this, it has been turning in the clockwise direction, and then should the roller be caused to come in operative contact with the other side of the guide, the roller will be turning in what may be regarded as the wrong direction. As a consequence, each roller undergoes skidding inside the track until it is stopped. Then each vane roller must reverse rotational direction and accelerate to the speed which will match the motion dictated by the other side of the roller guide. Because, in practice, vane machines generally require both positive inward and outward vane motion, rollers become impractical or non-functional in real machines where both motions are often demanded.

Other innovators have taught the use of sliding arc segment tethers in place of vane rollers. In such prior art instances, the arc segment tethers are captured within a circular annular groove that may or may not be rotatable. The arc segment vane tether has the outstanding and fundamentally important advantage of being able to deliver both positive inward and outward radial motion to the vane simultaneously. However, conventional vane motion control techniques use arc segment vane tethers which entailed considerable mechanical friction that arises from the sliding of the arc tether surfaces against the circular annular guides, whether or not the guides themselves are rotatable.

Further, and of fundamental importance, previous workers have failed to provide teachings of the specific contour that the internal casing profile must take on in order for the vane tips to mate closely in a non-contact but sealing relationship with this casing contour profile. Earlier innovators have either simply erred and believed that the proper casing contour was "circular", or circumvented the fundamental issue by characterizing the shape of the internal casing contour with words such as "substantially circular" and not teach operatively just how this fundamentally important shape is determined.

As an example of the foregoing problems, reference is made to U.S. Pat. No. 2,469,510 which shows a rotary vane machine which uses a static extension from the vane, the outside of which bears directly on the inner race of a standard ball bearing to limit outward radial motion. Inward radial motion is limited by the bearing contact of the underside of the vane extension against the outer race of a second conventional ball bearing. Springs shown in FIG. 5 are added to provide a positive outward radial vane bias. As the rotor rotates (assuming, for example, that the centrifugal forces are adequate or that springs are used) the static vane extensions engage the inner race of the outer standard ball bearing. Because the rotational speed of the vane extensions is constantly changing due to the eccentricity of the rotor with respect to the stator (this eccentricity is necessary, of course, for the volumetric changes required), there results a significant component of direct frictional sliding of the vane extension surface with respect to the rotating races of the respective ball bearings.

The inherent enforced sliding component of the vane extensions is about one-quarter of the pure sliding that would take place if the races did not rotate, i.e. a static annulus. While a three-fourths reduction in sliding appears to be significant, the remaining portion is still so large as the be impractical from the fundamental standpoints of wear, reliability, and friction. Significantly, the remaining 25% component of pure sliding is a minimum case. This minimum will be reached only if the rotating races, propelled by the friction arising among all the vane extensions rubbing on the bearing races, are identical to the rotor speed. Of course, this condition can never arise in actual practice because the friction between the vane extension and the rotating surface of the ball bearing constantly varies as the rotor turns. For example, when the vane is most extended, the centrifugal force generated by the motion of the vane and its mass is significantly higher than when it is at the least extended position. This situation is aggravated by the fact that not only does the peak rubbing force arise when the vane is in its outermost position, but the friction moment arm of the vane extension is also largest in that position. Therefore, the vanes that are more extended will tend to accelerate the rotation of the rotating race of the ball bearings at the expense of the vanes which are less extended. This real effect is estimated to be about double the rubbing friction. Therefore, an actual machine would have to contend with a much larger amount of friction and wear on the order of half that experienced by a conventional unconstrained vane machine. A commercial compressor of this type cannot be built because of this inherent problem.

U.S. Pat. No. 4,958,995 is another example of conventional vane pumps with, however, an objective to provide anti-friction vane control. For instance, FIGS. 27 to 29 show a large diameter ball bearing-mounted rigid rotating annular-grooved plate that performs the same function as the rigid rotating annular ball bearings, but requires that the vane extensions be placed nearer the tips of the vanes. This large diameter plate actually rotates with the rotor and thus provides essentially rotating endplates to minimize the relative motion between the rotor/vane assembly and the endplates. This arrangement unnecessarily complicates the construction of the pump. FIGS. 27, 28(I), and 28(II) show the replacement of the annular roller bearings shown in FIGS. 1 to 3 by a solid annular ring that is equipped with various hydrodynamic grooves that purport to help the ring run on a lubricant film. However, the vane extensions rub against this rotating ring just as in the previously discussed arrangements. FIG. 29 shows another embodiment in which only a single outer annular ball bearing is utilized against which the vane extensions rub. In none of the disclosed embodiments, however, is any mechanism disclosed for greatly minimizing or totally eliminating this rubbing friction.

As will be seen in considerable detail hereinafter, the present invention not only eliminates the majority of the mechanical sliding friction endemic to previous techniques, but does so with fewer and simpler components than were required by the prior art. At the same time, my invention accomplishes the fundamentally important positive bi-axial radial vane motion control necessary for the practical operation of such machines. Finally, my invention accommodates the natural motion of the tips of circularly-tethered vanes by providing exceedingly close non-contact vane tip sealing as a result of properly shaping the mating or conjugate interior of the casing wall.

The embodiments shown and described herein are ideally suited for use as an automotive air conditioning compressor, although my invention may be used in many other applications and relationships. A major aspect of my present invention is comprised of embodiments of a freely rotating bearing (FRB), which center upon simple, anti-friction, easily-producible, economical, and positive retention or motion-positive means of ensuring the accurate transfer of radial movement from the circular radial vane guide to the vane. The cooperation of these means of precise anti-friction vane motion control with the proper internal casing profile, which I prefer to call a conjugate casing contour, results in maintaining an excellent sealing but non-contact and, thus, minimum friction relationship between the tips of the vanes and the internal conjugate stator contour. Such a condition yields a simple vane type fluid handling device of a high volumetric and energy efficiency.

An early actual prototype compressor of the type disclosed herein demonstrated in practice the efficacy of my invention. For example, while operating at only 1000 rpm with R-12 refrigerant at 40° F. evaporation and 120° F. condensation, the volumetric and adiabatic/isentropic efficiencies were measured respectively to be 81% and 88%. Conventional well-developed compressors operating under these demanding conditions produce volumetric and adiabatic/isentropic efficiencies on the order of only 60% and 70%, respectively.

One of the principal vane motion control embodiments involves the use of plain arc segment vane tethers that are pinned pivotally to the vanes and that ride directly upon freely-rotating retained rollers that roll inside the internal surface of the circular, non-rotating radial vane endplate guides. Another embodiment involves vane tether elements resembling roller skates, also pivotally-pinned to the vanes, that ride in non-rotating circular vane guides located in the endplates of the device.

The present invention fully eliminates all the components of rubbing between the pivoting vane gliders or tethers and the anti-friction rolling elements rolling within this annular channel race. This has been achieved by allowing full freedom of constrained rolling motion of the rollers contained within the outer channel race and the outer surface of the vane glider. However, for start-and-stop conditions, a simple retainer ring placed in the inside diameter region of the rollers is included to ensure that the rollers never fall out or get caught between respective vane gliders.

According to yet another embodiment of my invention, I provide another way of minimizing the friction between the vane gliders and the end-plate annuli. This embodiment is non-mechanical and depends upon the use of special low-friction interface materials or surface coatings. The use of such an annular liner is quite practical at least for moderate speeds. It is of commercial interest (even though its frictional component will necessarily be higher than pure rolling), especially because it is lower in cost compared to the true rolling element embodiment.

The present invention is distinguishable from the engine disclosed in the above-discussed U.S. Pat. No. 2,469,510 by virtue of the absence in my invention of the rigid rotating roller races of the conventional roller bearings that interface with the vane extensions. The elimination of these ground and hardened races by using a pivoting tether that is pinned to the vanes in lieu of the rigid vane extensions substantially reduces sliding friction and hence wear.

The bearing utilized in the present invention replaces the standard integral bearings comprising rigid inner and outer races separated by roller or ball rolling elements. Specifically, the single rigid inner race of the conventional type of roller bearing has been eliminated and replaced by separate individual sections in the form of the vane gliders that are supported directly by the anti-friction rolling elements with no intervening rigid race. Not only does this permit direct transmission of rolling motion, but the individual vane gliders independently accommodate the cyclic variation of circumferential velocity of the vanes. This constantly-changing circumferential velocity occurs, of course, due to the eccentricity of the rotor with respect to the stator and, again, is required in order to change the volume of the compressing gas pockets. The physically independent or separate nature of the rollers eliminate the sliding friction component inherent in prior art devices which relied upon a single rigid inner race.

A compressor built in accordance with the principles of my invention directly transfers the motion of varying speed vanes to essentially independent rolling elements. There is no intervening interface component such as the rotating ball bearing race as is shown in U.S. Pat. No. 2,469,570 that, due to its rigidity as a continuous ring, necessitates physical rubbing between the vane motion control extensions and the rotating rings. While those of a conventional "unit cage" made up of conventional rollers retained by conventional roller cages can be used, a slight component of rubbing will occur between the rollers and the cage. Even this component of rubbing can be eliminated, however, by providing a retainer cage for the rollers with sufficient space between rollers to allow the variable velocity rollers to freely rotate between the race annuli and the surfaces of the vane guide.

Similarly, none of the embodiments shown in U.S. Pat. No. 4,958,995 are true anti-friction devices in the sense of the present invention, notwithstanding that they seek to achieve anti-friction vane control. The prior art antifriction devices, unlike the present invention, produce large components of rubbing and sliding friction between the so-called anti-friction means and the vane extensions regardless of configuration because the vane extensions engage a rigidly rotating annular subcomponent. Moreover, the precise operating or conjugate shape which I have found to be required of the inner stator profile (or the vane tip profile) for non-contact vane machines has not been previously taught or achieved. My invention thus provides the very small physical clearances between the dynamic interfaces so as, on one hand, to minimize leakage and, on the other hand, to avoid physical contact which produces rubbing friction and wear.

I have also found it possible to achieve stator and vane tip circularization, i.e. a true circular interior profile and a true circular arc-shaped vane tip to achieve exact conjugate non-contact sealing geometry. The stator/vane tip circularization has been achieved by placing the center of the vane tip radius at the exact coincidence with the glider axle center and making the tip radius equal to the difference in the radii of the stator and the radius of the path of the glider axle centerline. The result is a truly circular sealing noncontact interior stator contour. Of course, this radius must be reduced by the amount of tip clearance desired, e.g. 0.001" to 0.002". Alternatively, this clearance can be achieved by increasing the radius of the circular stator by the same amount.

As will become more apparent as the detailed description proceeds, the anti-friction vane motion control embodiments revealed here are combinable to yield yet additional embodiments which can be used quite effectively, depending upon the purpose to be served.

It is therefore primary object of my invention to provide a vane type fluid displacement machine that accomplishes non-contact vane tip sealing in a particularly simple and energy efficient manner and which is relatively easy to manufacture and to maintain in service.

It is another important object of my invention to provide a non-contact rotary vane machine that is extremely reliable, and which can operate with a wide variety of refrigerants, including those not harmful to the Earth's stratospheric ozone layers.

It is still yet another object of my invention to provide a non-contact vane type compressor whose vane tips are positioned by the utilization of circular radial vane guides, eliminating the use of the costly non-circular vane guides extensively utilized by the prior art.

BRIEF DESCRIPTION OF THE DRAWINGS

These and other objects, features and advantages of the present invention will become more apparent from the following detailed description of several presently preferred embodiments when taken in conjunction with the accompanying drawings wherein:

FIG. 4*c* shows yet another embodiment of a vane tether using freely-rotating retained bearings operating on both the inner and outer peripheries of a plain arc segment vane tether;

FIG. 4*d* shows an arc segment vane tether embodiment equipped with trunnion rollers in the outside arc region which interface with a free-rotating retained roller bearing (FRB) disposed on the inner periphery of the annular surface of the radial vane guide;

FIG. 4*e* shows the combination of a caged freely-rotating retained roller bearing on the outside periphery of the arc segment vane tether and trunnioned rollers on the inner periphery of the tether;

FIG. 4*f* shows a vane tether embodiment equipped with trunnioned rollers on both its inner and outer peripheries;

FIG. 5 shows details of the non-circular stator contour geometry or conjugate internal conforming profile required for functional operation of my invention as a gas compressor or the like;

FIG. 6F is a view similar to FIG. 6D but on an enlarged scale;

FIG. 6G(1) through 6G(4) together are an exploded view of the twin roller assembly shown in FIGS. 6D and 6F;

DETAILED DESCRIPTION OF PRESENTLY PREFERRED EMBODIMENTS

Figure 1:
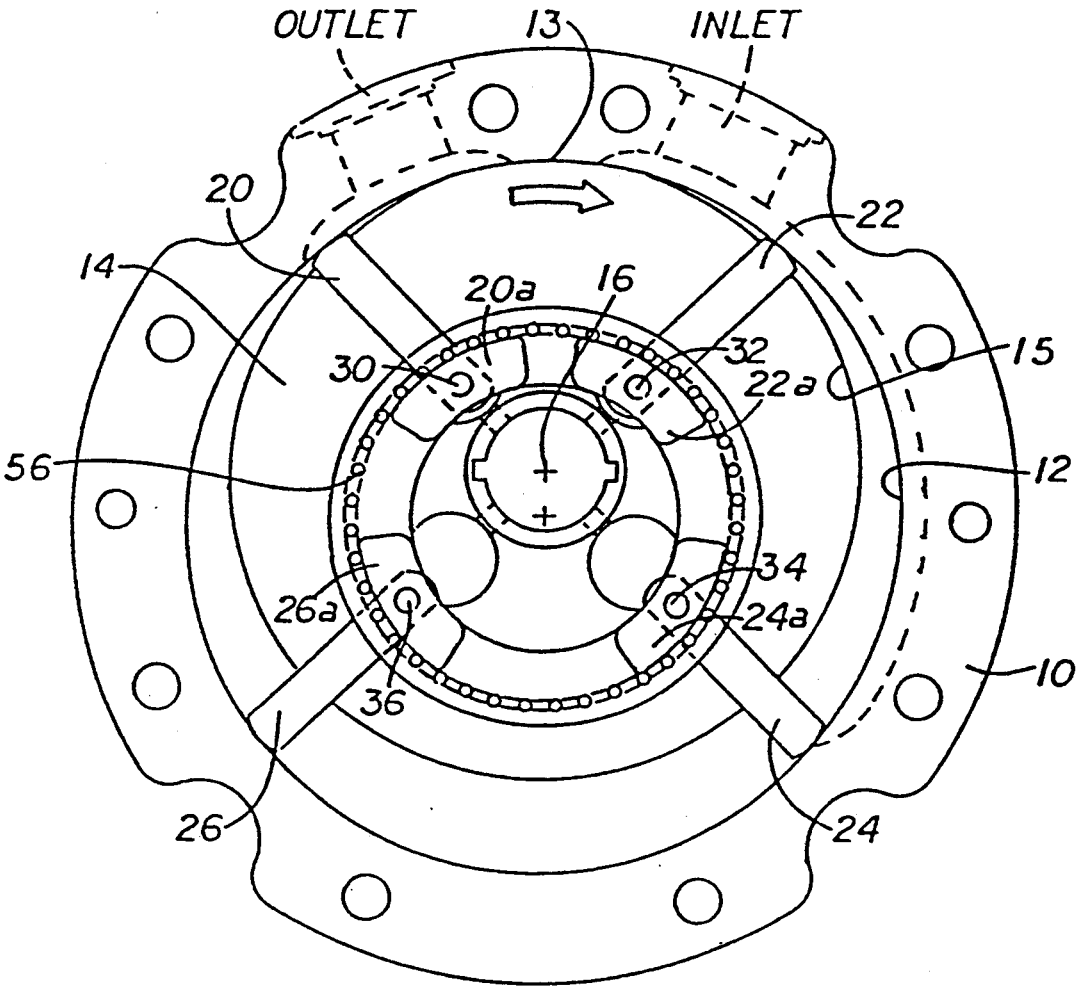
FIG. 1 is an elevational view of my invention, with one endplate removed so as to reveal the rotor equipped with the tethered sliding vanes and an accompanying annular vane guide.

In order to understand further the function and operation of the non-contact vane-type fluid displacement machine in accordance with a first embodiment of this invention, reference is first made to FIG. 1 which illustrates many of the principal elements of my invention. These elements include the casing which is equipped with an internal profile contoured specifically to tangentially mate in a sealing but non-contact relationship with the actual controlled motion of the tips of the vanes as they are carried within the rotor. This cooperation thus maintains sealing but non-contact relationship therebetween. I prefer to refer to this internal conforming profile as a conjugate or conformal profile, and the precise technique by which this conjugate profile is determined is explained in detail hereinafter.

With continuing reference to FIG. 1, it will be noted that rotor 14 is disposed in an eccentric relationship to the internal conforming profile 12 of the casing 10, with center point 16 denoting the axis about which rotor 14 rotates. Although I am not to be limited to any particular number of vanes to be carried by the rotor 14, for purposes of illustration I have shown vanes 20, 22, 24 and 26 which, for all intents and purposes, can be regarded as being identical to each other. Further, it can be seen that these vanes are equipped with what I prefer to call vane tethers or gliders, these being denoted as 20*a*, 22*a*, 24*a* and 26*a*, respectively. These vane tethers can themselves also be considered, for all intents and purposes, identical to each other and to cooperate with the vanes through pins 30, 32, 34 and 36 or the like. The vanes 20, 22, 24 and 26 may be seen more clearly and in more detail in FIG. 3.

As will be understood by those skilled in this art, fluid to be compressed is admitted through the port denoted INLET in FIG. 1, and the compressed fluid is delivered out of the port captioned OUTLET.

Figure 1A:
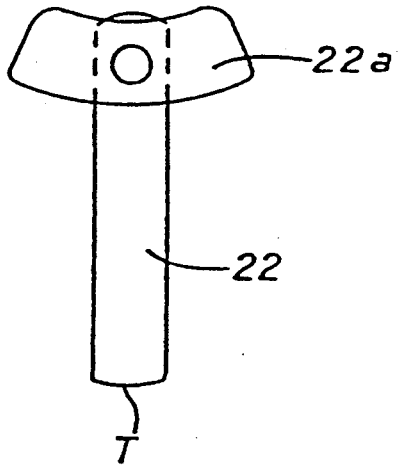
FIG. 1*a* illustrates a break-out or isolated view of one of the glider/vane assemblies of FIG. 1.

In FIG. 1*a* I have shown details of a typical vane and its corresponding tether. As noted, this vane is captioned as vane 22, and its tether 22*a*, and is further equipped with a carefully located circular arc vane tip, indicated as T. In accordance with this invention, the vane tip T is intended to travel immediately within the tangentially conforming inner wall 12 of the stator 10 in an exceedingly close yet substantially frictionless non-contacting relationship.

Figure 2:
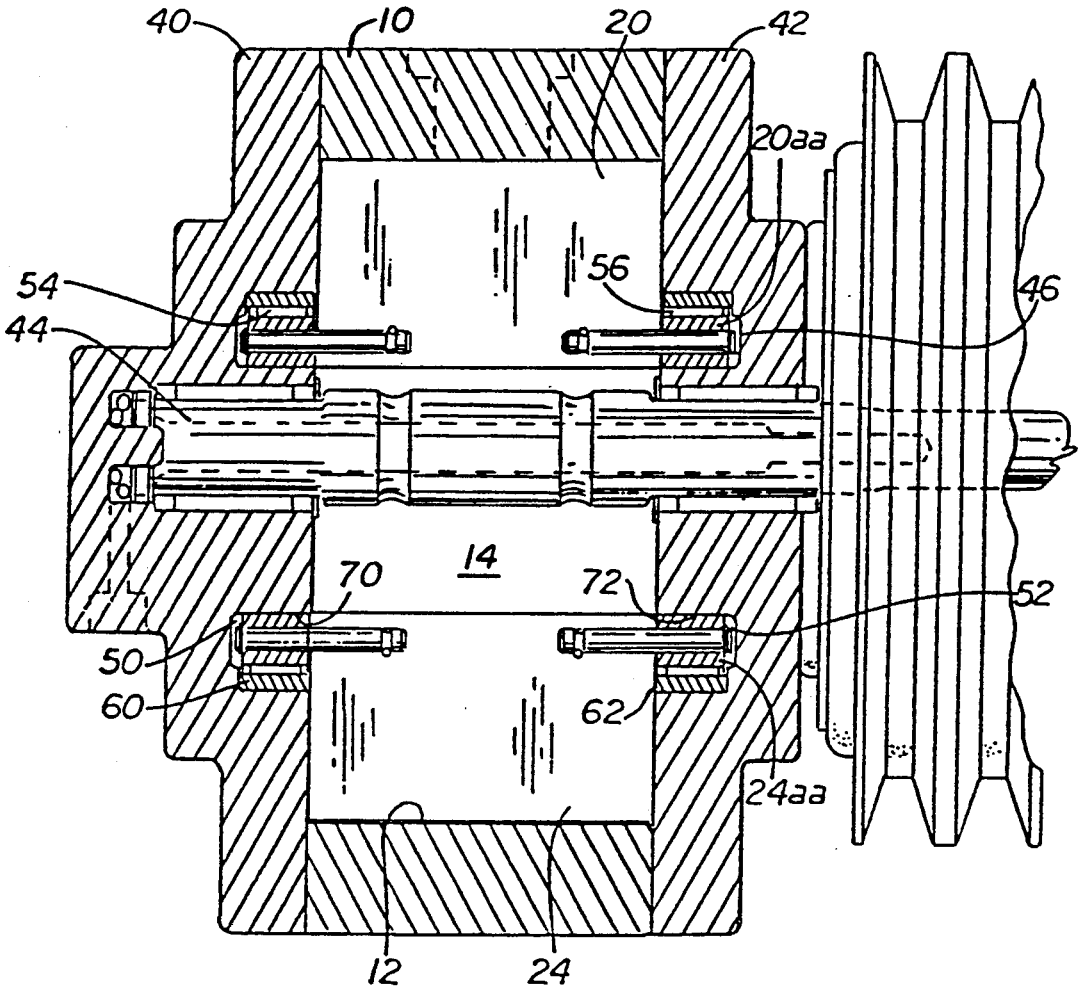
FIG. 2 is a side partial cross sectional elevational view of the embodiment of my invention shown in FIG. 1 showing certain vanes with their tethers in the tether annuli in opposing endplates.
Figure 2A:
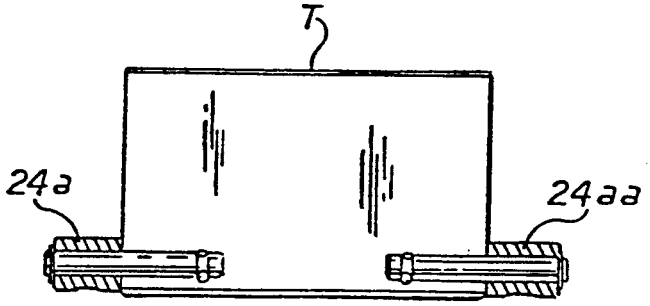
FIG. 2*a* illustrates a break-out or isolated view of the sideview of a typical vane/tether assembly of the embodiment of FIG. 2.

A mechanism in accordance with this invention by which precision vane motion can be accomplished with a minimum of mechanical friction can be seen by referring to FIGS. 1, 1*a*, 2 and 2*a*. It is to be understood that vane tethers 20*a*, 22*a*, 24*a* and 26*a* have identical companions utilized on the opposing side of each of the respective vanes through the action of corresponding tether pins, and it is therefore sufficient to describe only a single set of tethers associated with each vane. Visible in FIG. 2*a* are tethers 24*a* and 24*aa* with tip T. These and the other sets of vane tethers, operating in conjunction with certain endplate annuli and anti-friction means to be described in more detail hereinafter, are responsible for each vane tip T moving in the aforementioned desired exceedingly close yet substantially frictionless relationship to the inner conjugate profile 12 of the casing 10.

Referring now specifically to FIG. 2, the casing 10 is bounded on its left and right sides by the endplates 40 and 42 which, for the purposes of explanation, are substantially identical except that the rotor shaft 44 protrudes through the right endplate. These endplates are secured to the casing 10 by any conventional means, such as through-bolts, and such details are of no particular concern to this invention.

As shown in FIG. 1., it is clear to those skilled in this art that volumetric changes can be brought about with rotor rotation because of the eccentric relationship between the axis of the rotor 14 and its attending set of vanes 20 through 26, the supporting opposing endplates, and the internal conforming profile 12 of the casing. This is, of course, brought about in such a way that pumping or compression of fluids entering through the INLET can be accomplished and discharged through the OUTLET, as previously mentioned. However, for the compression and/or pumping to be accomplished efficiently, the periphery 15 of rotor 14 must sealingly engage the internal casing profile in region 13.

It can be noted from FIG. 2 that rotor 14, which is rotatably supported in the endplates 40 and 42 by the shaft 44, may be considered either to be integral with the shaft, or to be engaged with the shaft in a close axial sliding fit, having a zero relative rotation. Suitable bearings are utilized in the endplates in order that the rotor shaft 44 and rotor 14 can freely rotate, and it is understood that the left and right faces of rotor 14 are operatively disposed in a contiguous sealing relationship with the inner walls of the endplates. Suitable lubrication is provided at this interface and in other locations within the machine, in accordance with well-known techniques.

It can be further noted in FIG. 2 that I have opened portion of the drawing in order to reveal the presence in each illustrated endplate of the earlier-mentioned circular annuli, with annulus 50 being located in endplate 40, and annulus 52 being located in endplate 42. It can also be noted that the center of these annuli are coincident with the geometric center of the interior casing of the conforming profile 12. It is quite important to observe that because these annuli are circular rather than noncircular, manufacturing costs are minimized by this aspect of my technique. Further savings in manufacturing costs and increases in machine performance can be derived from employing annuli which can be produced separately from the endplate itself and then joined with the endplate during assembly as shown in FIG. 1.

In order to facilitate the utilization of one friction minimizing means in the annuli, I prefer, as indicated above, to dispose a hardened steel ring 60 in annulus 50, and a substantially identical hardened steel ring 62 in annulus 52. It is an annular ring 60 that the tethers 20*a*, 22*a*, 24*a* and 26*a* travel as seen in FIG. 1, whereas their companion vane tethers travel in annular ring 62 shown in FIG. 2 as the rotor 14 rotates in the casing 10.

Although my invention would be operative without friction minimizing means utilized with the conjugate internal casing profile 12, I find it greatly preferable to utilize a freely-rotating caged roller bearing inside each of the hardened steel rings, with FIG. 2 revealing that bearing 54 is utilized in ring 60 located in annular 50, whereas bearing 56 is utilized in annulus 52.

Continuing with FIG. 2, it will be seen by the utilization of this centrally-disposed cross-sectional view, that I have exhibited that the roller bearings 54 and 56 are arranged to ride inside the hardened steel rings 60 and 62, respectively, in order to provide a minimal friction guide means for tethers 20*a*, 22*a*, 24*a* and 26*a*. These tethers are, of course, respectively associated with the aforementioned vanes 20, 22, 24 and 26 with a like condition occurring on the opposite side of the machine.

Because of the advantageous techniques I utilize, the vane gliders, in traveling inside the caged roller bearings disposed in the interior of the respective annuli, will not only experience minimal friction directly, but will also guide vane tips T in a minimal friction relationship with the internal conjugate sidewall 12. Thus, this embodiment of my invention elegantly achieves the paramount goal of yielding a substantially frictionless yet highly effective sealing relationship between the tips T of the vanes and the corresponding conjugate interior surface 12 of casing 10 that can be easily manufactured. The specific means by which the interior surface 12 is developed in accordance with the teachings of this invention will be set forth in detail hereinafter.

At this juncture, however, it is advantageous to realize that the foregoing description can be interpreted in such a fashion as to consider the rings 60 and 62 as behaving as the outer races of conventional roller bearings but with the inner races actually consisting of a plurality of independent circular segments which happen to be pinned to the vanes and thus behave as vane tethers or gliders. The caged roller bearings 54 and 56 therefore function in much the same fashion as conventional caged bearing assemblies. Certain of the rollers or roller bearings of the additional tether embodiments in accordance with the invention will be understood to experience both sliding and rolling, much as do the rollers in both full-compliment and retained or caged roller bearings.

As emphasized hereinbefore, an important and basic objective of this invention is to ensure positive radially inward vane motion control as well as positive outward vane motion control. This fundamentally important machine function is provided elegantly as shown in FIG. 2 by the plain outer diametrical surfaces 70 and 72, each being respectively the inner peripheral surfaces of annuli 50 and 52, themselves respective of endplates 40 and 42. The circular peripheral surfaces 70 and 72 serve, through their cooperation with the inner peripheries of the vane tethers, to positively limit the inward radial travel of the vanes. Thus, the combined action of the outward-motion-limiting free-rotating bearings 54 and 56, operating in conjunction with respective hardened steel rings 60 and 62, with the inner peripheries of inner annular surfaces 70 and 72, serve to positively define the radial motion of the vane tethers moving therebetween. Thus it is to be seen that this arrangement uniquely defines the path of travel of the vane tips, with vane tip T of vane 22 being shown, for example, in FIG. 1*a*.

Figure 3:
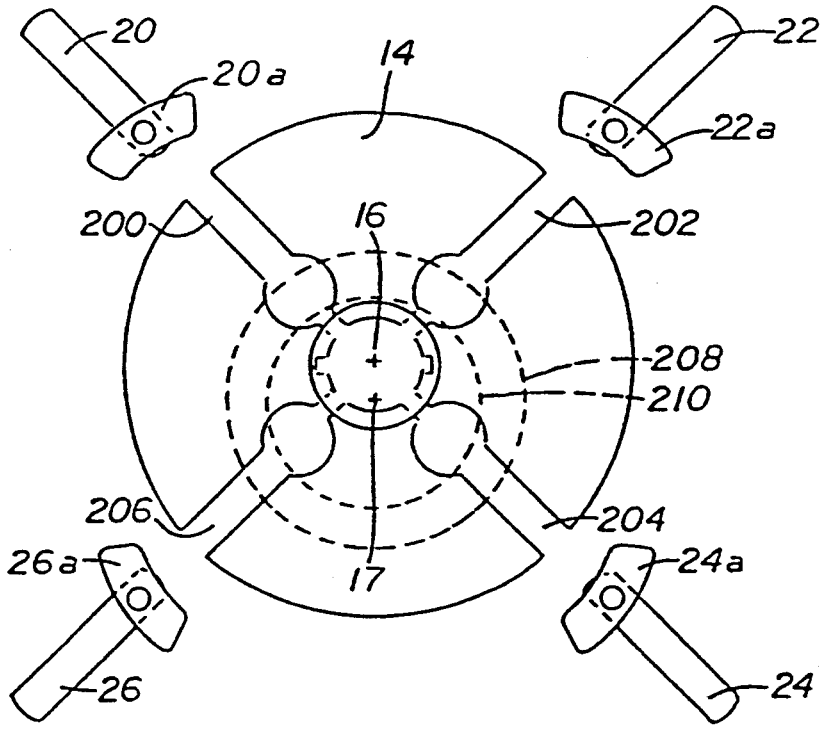
FIG. 3 is a front view of the rotor used in the embodiment of FIGS. 1 and 2 with a corresponding set of tethered vane assemblies depicted in exploded relationship out of their respective rotor slots and the annular surfaces located in the endplates that serve to guide the vane tethers shown in dashed lines.

FIG. 3 is presented to further elucidate the relationships arising among the rotor 14, the rotor slots 200, 202, 204 and 206 and their corresponding vanes 20, 22, 24 and 26 which are shown radially separated from their actual locations within the rotor slots. The radially outwardly disposed governing surface 208 and the radially inwardly governing surface 210 of the annular vane tether guide are shown in broken lines in FIG. 3 in their proper relationship to the rotor center 16. Point 17 is the coincident center of both the circular annulus and the internal stator casing profile 12. It is these annular surfaces which enclose the vane tether and the anti-friction bearing means interposed therebetween, and thus dictate the circular anti-friction path of the vane tethers.

Figure 4A:
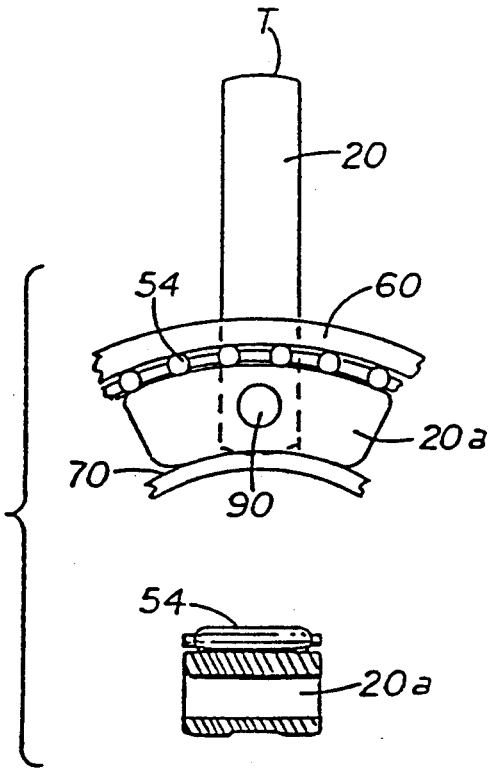
FIG. 4*a* shows enlarged details of the construction of one of the embodiments of my invention that utilizes a freely-rotating caged bearing friction minimizing structure, with plain, non-rolling positive outward radial motion control.

Attention should now be given to FIG. 4*a* which shows yet additional detail regarding the anti-friction radial vane guide embodiment previously discussed. Note especially that this drawing illustrates the construction and cooperation among the outer radial vane guide race 60, the freely-rotating caged bearing 54, and, for example, tether 20*a*, and the inner peripheral annular surface 70. The face end of vane tether pin 90 is shown here that pivotally connects vane tether 20*a* with vane 20.

It is to be understood in FIG. 4*a* that a slight clearance exists, in accordance with embodiments revealed herein, between the underside peripheral surface of the arc segment vane tethers and the circular peripheral surfaces 70 and 72 of annuli 50 and 52. This clearance is important for two reasons. One reason is because simultaneous contact with these internal annular surfaces is ordinarily not needed or wanted because the radially positive centripetal forces on the vane assembly during machine operation are usually sufficient to maintain positive outward radial vane motion. Another reason, which is more subtle, arises when my invention is used as a vapor compressor in an air conditioning system. At start-up or during off-design operating conditions, it is not uncommon for a certain amount of liquid refrigerant to occasionally enter the INLET (shown in FIG. 1*a*) of the machine. This occurrence is known as liquid "slugging".

If no inward radial slack is available to the vane, extreme pressures can sometimes arise within the compression region of the device and potentially cause significant damage to the device. Thus, the interface clearance between the inner annular surfaces 70 and 72 and the underside peripheries of the vane tethers also provide, in the case outlined here, a built-in "safety valve". The amount of clearance required to prevent damage from liquid slugging is relatively slight, being only on the order of 0.02 to 0.2 mm and therefore functions in harmony with the embodiments herein described.

Figure 4B:
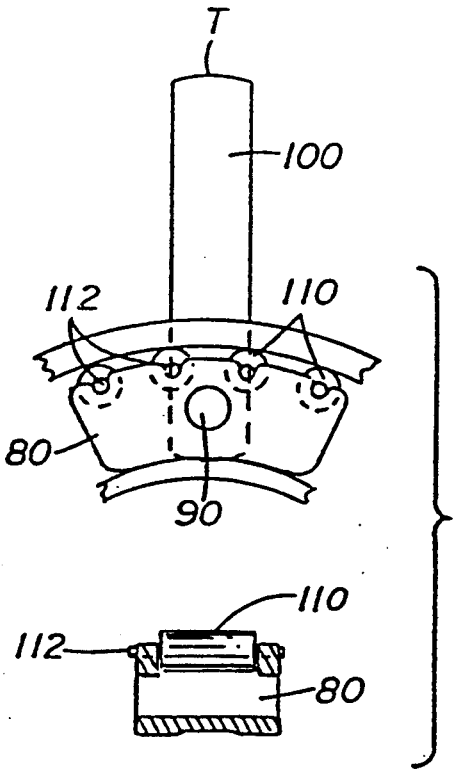
FIG. 4*b* shows enlarged details of the construction of another embodiment of a tether glider in which the tether has trunnioned rollers for positive inward motion control and plain positive outward radial motion control.

Attention is now directed to FIG. 4*b*, where a second basic vane tether assembly is presented. In the case of the vane tether depicted here, the vane tether frame 80, which is attached to vane 100 via tether pin 90, is fitted with trunnioned rollers 110. The trunnions 112 of trunnioned roller 110 ride within the circular bottom bearing slots 120 of the vane tether frame 80. In this arrangement, the freely-rotating retained needle bearing assembly shown previously is eliminated and effectively replaced by the trunnioned rollers residing within the vane tether frame 80.

FIG. 4*c* portrays yet another combination bi-axial radial vane motion control embodiment. The peripheries of vane tether 170 are plain on both the inner and outer surfaces. Both of these outside peripheral tether surfaces then ride between the outer and larger freely-rotating retained roller bearing assembly 172 and the inner and smaller freely-rotating bearing 174. The outer caged freely-rotating bearing 172 thus rides inside bearing race 176 and the inner caged freely-rotating bearing 174 rides over the inner bearing race 178. Such an arrangement as portrayed here also ensures positive anti-friction control of both inward and outward radial motion of the vane/vane tether assemblies.

FIG. 4*d* shows still another positive bi-axial anti-friction radial vane motion control embodiment. The outer periphery of the arc segment vane tether frame 160 is again equipped with rollers 110 of whose trunnions 112 engage trunnion slots 120. Again, these trunnioned rollers 110 ride rollingly inside outer bearing race 162. The inner periphery of this tether segment 160 then engages the inner freely-rotating retained roller bearing 164 which, in turn, rides upon the inner annular bearing race 166.

Shown in FIG. 4*e* is yet another embodiment of positive bi-axial radial vane tether motion control system. The vane tether frame 180 is equipped with trunnioned rollers 110 on its inner periphery. These inner trunnioned rollers then roll over the outer annular peripheral surface 182. However, as seen in the previous embodiments, the outer peripheral surface of tether frame 180 rides upon the freely-rotating retained roller bearing assembly 184 which, again in turn, rides upon outer annular race 186. Once more, an embodiment is shown that provides positive bi-axial anti-friction radial vane motion.

FIG. 4*f* shows still another double-acting or bi-axial anti-friction vane tether frame embodiment. Frame 140 is equipped with trunnioned rollers 110 whose trunnions 112 engage outer peripheral trunnion slots 120 and inner trunnion slots 130. Such an arrangement can also be used when positive bi-axial motion is preferred using anti-friction means. In such a case as shown here, the inner trunnioned rollers 110 ride upon the inner peripheral surface of bearing ring race 142. Such particular means is well equipped to handle especially heavy inward radial loads.

As emphasized throughout the foregoing, the geometric shape of the inner wall 12 of the stator casing 10 shown in FIG. 1 is critical on the illustrated embodiment to the efficient function of my invention. Appreciation for this governing fact can be seen in FIG. 5 which is a magnified view of the conjugate or mating internal casing profile that is an important aspect of this invention. The general variance of the contour 12 from a pure circle becomes quite apparent. Unless a special set of geometric relationships are employed as discussed below, it can be seen that the vane tip T actually recedes significantly inside the part of a true circular contour as the vanes rotate and reciprocate with the rotor.

The reason for this general geometric effect is due to the fact that, although the vane tether pin follows a true circle, the necessary rotor-to-stator eccentricity (offset $\Delta y$) causes the vanes to tilt at a varying but cyclic angle with respect to the slope of the inner stator contour. Further, the point of line of tangency at the vane tip T to the internal conjugate casing profile 12 continuously changes location with the motion of the vanes. The complex and subtle vane motion thus describes a contour that generally resembles a circle that is compressed about its equator.

Figure 5:
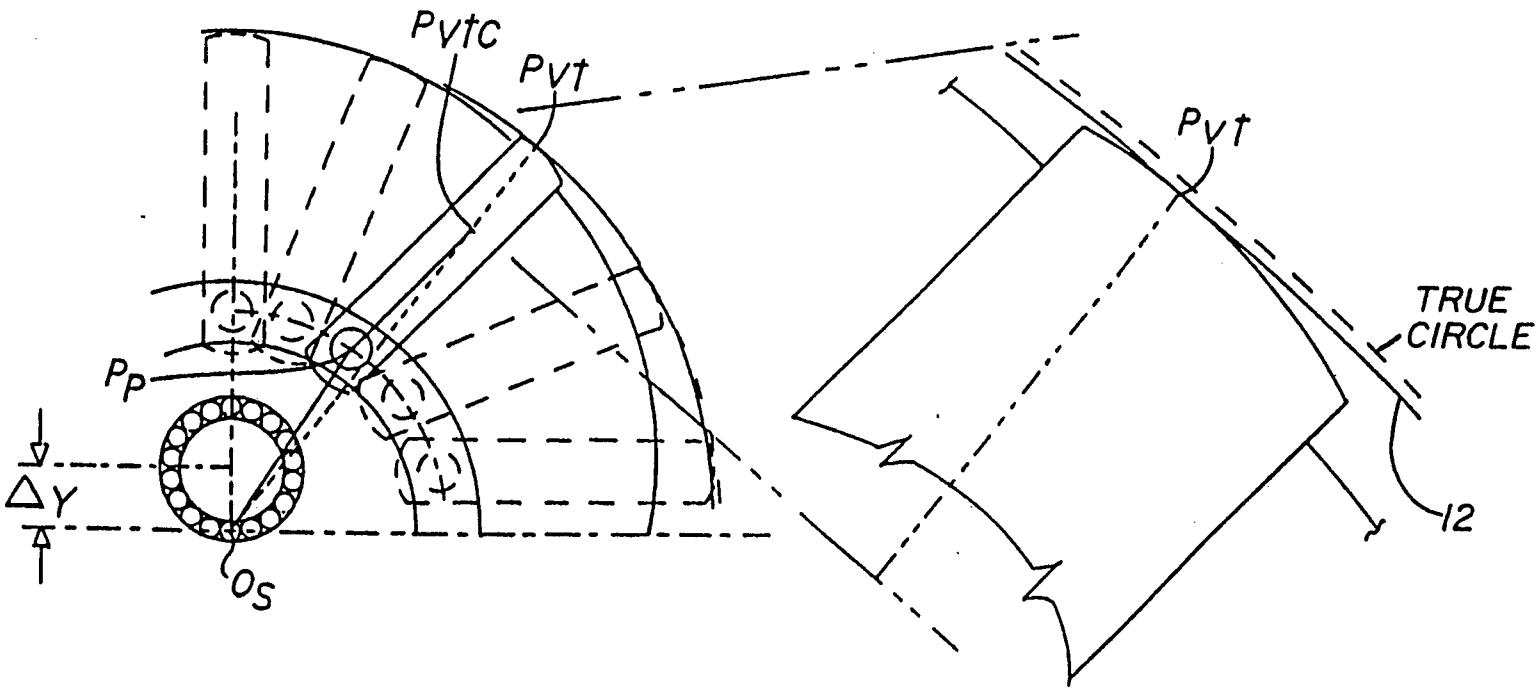

Recall that a fundamental assignment of machines such as disclosed here is to efficiently compress gases or pump liquids. This can be achieved only if the distance between the line of tangency of curves vane tip T and the inner stator contour 12 of the casing 10 if very small; on the order of only a few hundredths of a millimeter. Thus, my invention can function at a high efficiency only if contour 12 takes on this very special and generally non-circular shape. If a true circular stator contour were used without special geometric considerations as mentioned earlier and described in detail below in discussing another embodiment of my invention, and as can be seen in FIG. 5, large leakage gaps develop between the vane tip and stator housing wall. The development of such leakage gaps using a true circular stator interior (again without special and specific part geometries as later discussed) is many times larger than would be acceptable for efficient performance. Therefore, very close attention must be brought to bear in determining the unique shape of the interior stator wall.

With continuing reference to FIG. 5, the general required geometrical condition can be seen for the vane tip to remain tangent to the inner stator contour 12 at all angular locations of the rotor/vane assembly. I have found that the precise point of tangency of the vane tip with contour 12 can be determined by constructing a line from the geometric center $O_s$ of the vane guide ring (which is also the geometric center of the conjugate internal casing contour 12) to the center of the radius of the vane tip, Pvtc.

If this special line is extended to intersect the radial contour of the vane tip, this point of intersection (shown in FIG. 5 as Pvt) is exactly the location of the corresponding point required to define the conjugate casing interior contour 12. I have used this discovery in the creation of the required conjugate stator profile employed in accordance with portions of this invention, the details of which are now presented.

Knowing now the precise geometrical condition required to accurately define the conjugate internal casing contour 12, algebraic and trigonometric relationships can be applied to compute the entire locus of points that define this general contour. A direct computation algorithm for the required internal contour can be capsulized as follows in connection with FIG. 5:

A. Set initial extended angular location of the vane.
B. Locate the coordinates of the vane pivot pin, Pp, from a knowledge of the vane angle and the radius of the circular vane guide.
C. Compute the corresponding angle from the horizontal axis of the stator to the line from the stator center, $O_s$, and the vane tip radius center Pvtc, from a knowledge of the dimensions of the vanes and trigonometric functions.
D. Locate the coordinates of the vane tip radius center from the angle found in C. above and the lineal dimensions of the vane.
E. Finally, locate the coordinates of tangency point Pvt from a knowledge of the vane tip radius and the angle to the center of this vane tip radius from the stator center.
F. Repeat the calculations as needed by incrementing the angular location of the vane to generate the entire locus of points of the required internal conjugate casing contour.

The specific mathematical relationships which relate to the foregoing are next presented, also in reference to FIG. 5:

I. Definition of Initial Nomenclature:

Rg = Radius of annular vane tether guide
Rr = Radius of rotor
Rs = Vertical semi axis of internal stator profile
Rt = Distance from tether pin center to center of vane tip radius
rt = radius of vane
e = Rs − Rr; Rotor eccentricity
Ar = Rotor/vane output angle as measured from the horizontal and repeatedly incrementable to generate locus of conjugate stator profile points.

II Algebraic and Trigonometric Relationships:

1. Cartesian coordinates of vane tether pin centers as measured from the coincident center $O_s$ of the conjugate stator profile and the annular vane tether guides —

$$xg = Rg[\cos(Ar)]$$

$$yg = Rg[\sin(Ar)]$$

where cos and sin each represent the trigonometric cosine and sine functions, respectively;

2. Angle Ag of the line from the rotor center through the vane tether pin center Pp and through the vane tip radius center Pvtc as measured from the horizontal rotor axis —

$$Ag = atan[yg/xg]$$

where atan signifies the trigonometric arc tangent function;

3. Radius Rp from rotor center to tether pin center —

$$Rp = sqrt[xg\ \ 2 + yg\ \ 2]$$

4. Radius Rtc from rotor center to center of vane tip radius —

$$Rtc = Rp + Rt$$

5. Cartesian coordinates of vane tip radius center as measured from the stator profile center —

$$xtc = Rtc[cos(Ar)]$$

$$ytc = Rtc[sin(Ar)] + e$$

6. Angle At from stator center to vane tip radius center as measured from the stator horizontal axis —

$$At = atan[ytc/xtc]$$

7. Radius Rtc from stator profile center to center of vane tip radius —

$$Rtc = sqrt[xct\ \ 2 + ytd\ \ 2]$$

8. Extended radial distance Rtt from the stator center of the corresponding point of tangency Pct between the vane tip and the conjugate internal stator contour —

$$Rtt = Rtc + rt$$

Line Rtt, which is the key geometrical conjugate relationship, is represented by the phantom line shown in FIG. 5

9. Cartesian Coordinates of vane tip/stator wall tangency point Pvt—

$$xtt = Rtt[cos(At)]$$

$$ytt = Rtt[sin(At)]$$

The combination of angle At, found in numbered paragraph 6. above and the extended tangency radius Rtt, found in numbered paragraph 8. above defines the polar coordinates of the required conjugate stator profile 12 while the Cartesian coordinates of this same conjugate stator contour are found in paragraph 9. above as the rotor/vane angle Ar is incremented over 360 angular degrees.

It is to be understood that the very small continuous gap between the vane tip and the conjugate profile in an actual machine is created either by shortening the vane tip in relation to the desired magnitude of this small interface gap or by adding this constant gap width to the conjugate contour itself. That is, in the first case, the actual distance, Rta, between the vane tether pin and the center of the vane tip radius, is Rt diminished by a small clearance, say 0.025 mm; Rta=Rt−0.025 mm. Of course, the actual conjugate profile 12 is computed and manufactured on the basis of Rt.

In the second case, the distance Rt would remain physically the same, but the profile 12 would be computed and produced on the basis of Rtt increased by the small desired gap: Rtta =Rtt +0.025 mm. Both methods can satisfactorily generate the sealing but non-contact condition between the vane tip and the conjugate stator profile required for efficient operation by this invention.

Figure 8:
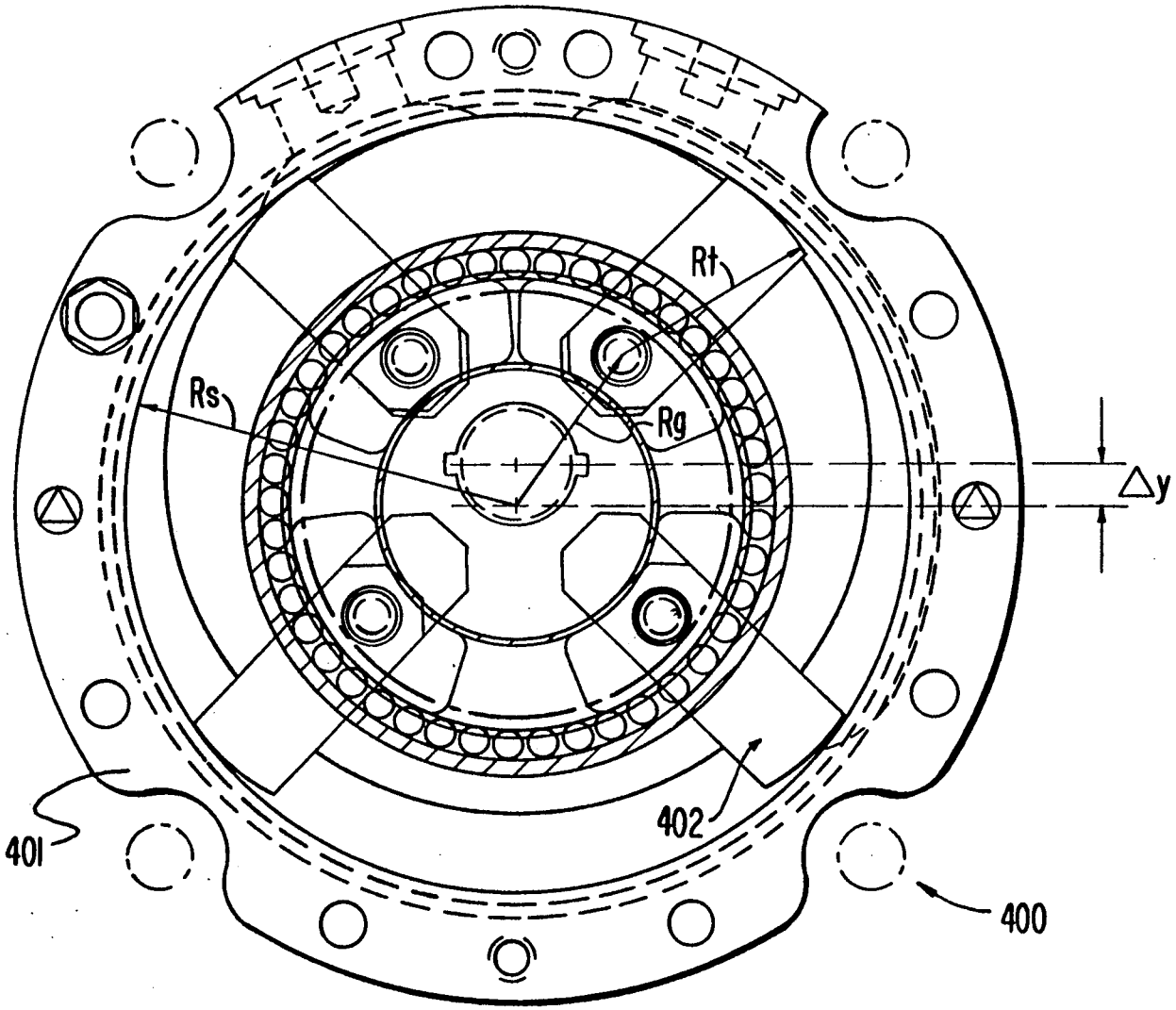
FIG. 8 is a view similar to FIG. 1 but showing another embodiment of the present invention in which a truly circular stator is employed.

With reference to the compressor embodiment designated generally by the numeral 400 in FIG. 8, the previously mentioned special case of stator circularity is achieved if the following specific geometrical conditions are met: a) the vane tip profile has a constant radius; b) the vane tip radius Rt is equal to the difference between the radius of the stator Rs and the radius of the anti-friction vane guide Rg, and c) the vane tip radius center is identically coincident with the center of the axle of the vane tether.

Specifically, to achieve multiple circularization of the stator of the compressor shown in FIG. 8, the following relationship must be satisfied:

$$R_t = R_s - R_g$$

where $R_t$ is the vane tip radius; $R_g$ is the vane guide radius and $R_s$ is the stator radius.

It is important to note that the thickness of the vanes 402 in FIG. 8 must be great enough to ensure tangential sealing across the entire vane tip.

In addition to the savings in manufacturing cost and part inspection, true stator profile circularization offers yet another advantage all related to product quality, energy efficiency, and further cost reductions. For example, the rear or closed endplate can now become an integral part of the stator because both parts can be made in a single concentric chucker production set-up. This not only reduces the parts count, but ensures the absolute accuracy of the parts. It also eliminates fasteners and one of the two "O"-ring seals. This also makes the machine even more gas-tight Further, the open or shaft side endplate can be located with virtually exact precision through the use of a shallow circular step that mates with the lip of the internal diameter of the stator 401.

The circular stator 401 makes it possible to produce my compressor to dimensional accuracies that are limited only by the super-precision of the manufacturing equipment's ability to produce cylindrical and flat surfaces. This is of extreme importance because it enables the achievement of the highest energy efficiency at the lowest possible cost.

In the embodiment according to FIGS. 6A–6G, there is shown a compressor designated generally by the numeral 300 with a twin roller tether arrangement 301 having two small rollers 302, 303 of identical construction, bearing mounted within a frame 308 which is tether-pinned to the sides of the vanes 304 by vane tether pins 305 as previously described with regard to the embodiments shown in FIGS. 1–4*f*. For convenience, parts similar in function and/or structure to those previously described in connection with FIGS. 1–4*f* will either be designated by the same numeral but primed in describing the following embodiments or the description will be dispensed with altogether where the similar function and structure are readily apparent to one skilled in the vane machine art.

Figure 6A:
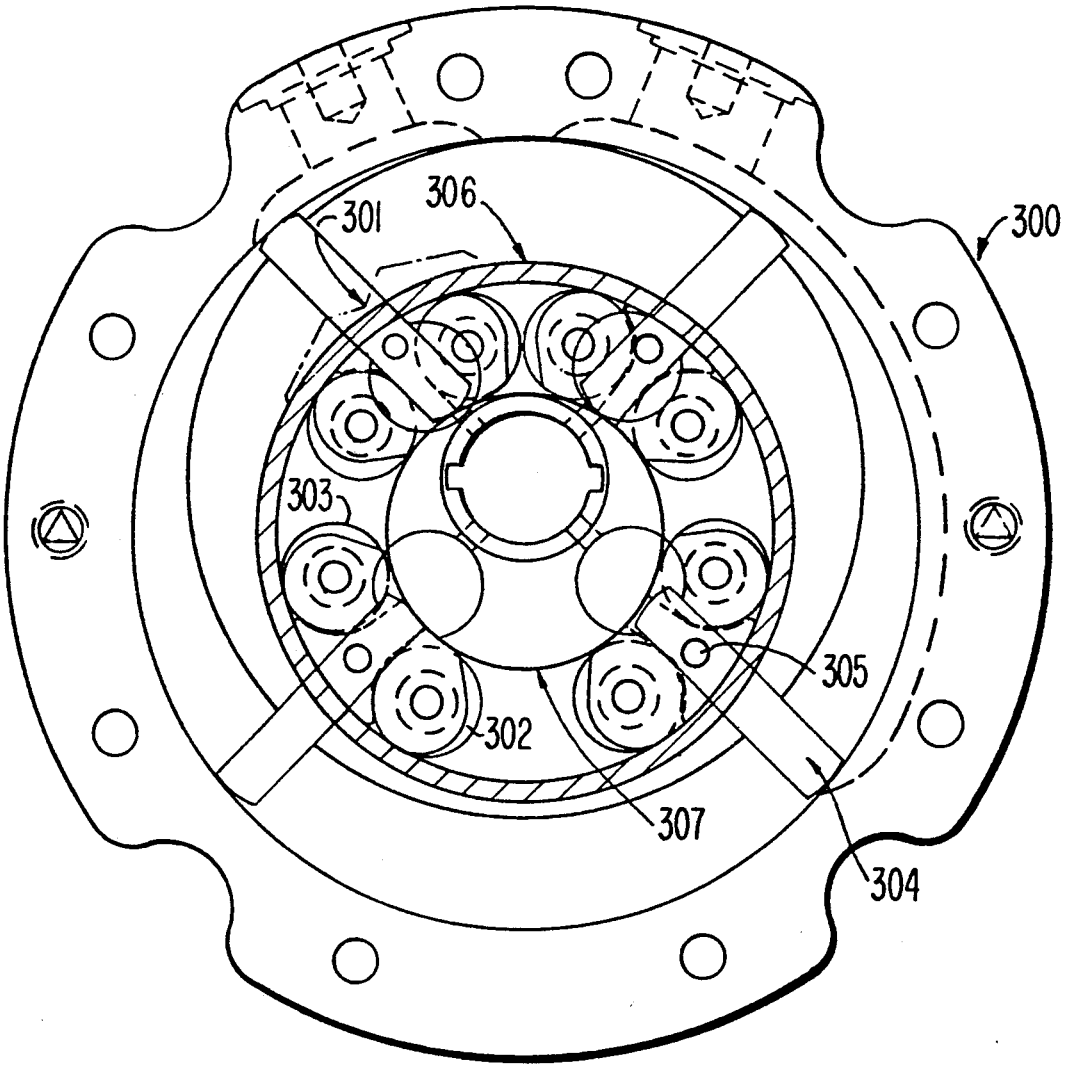
FIG. 6A is a view similar to FIG. 1 but showing another embodiment what I characterize as a twin roller tether arrangement.
Figure 6B:
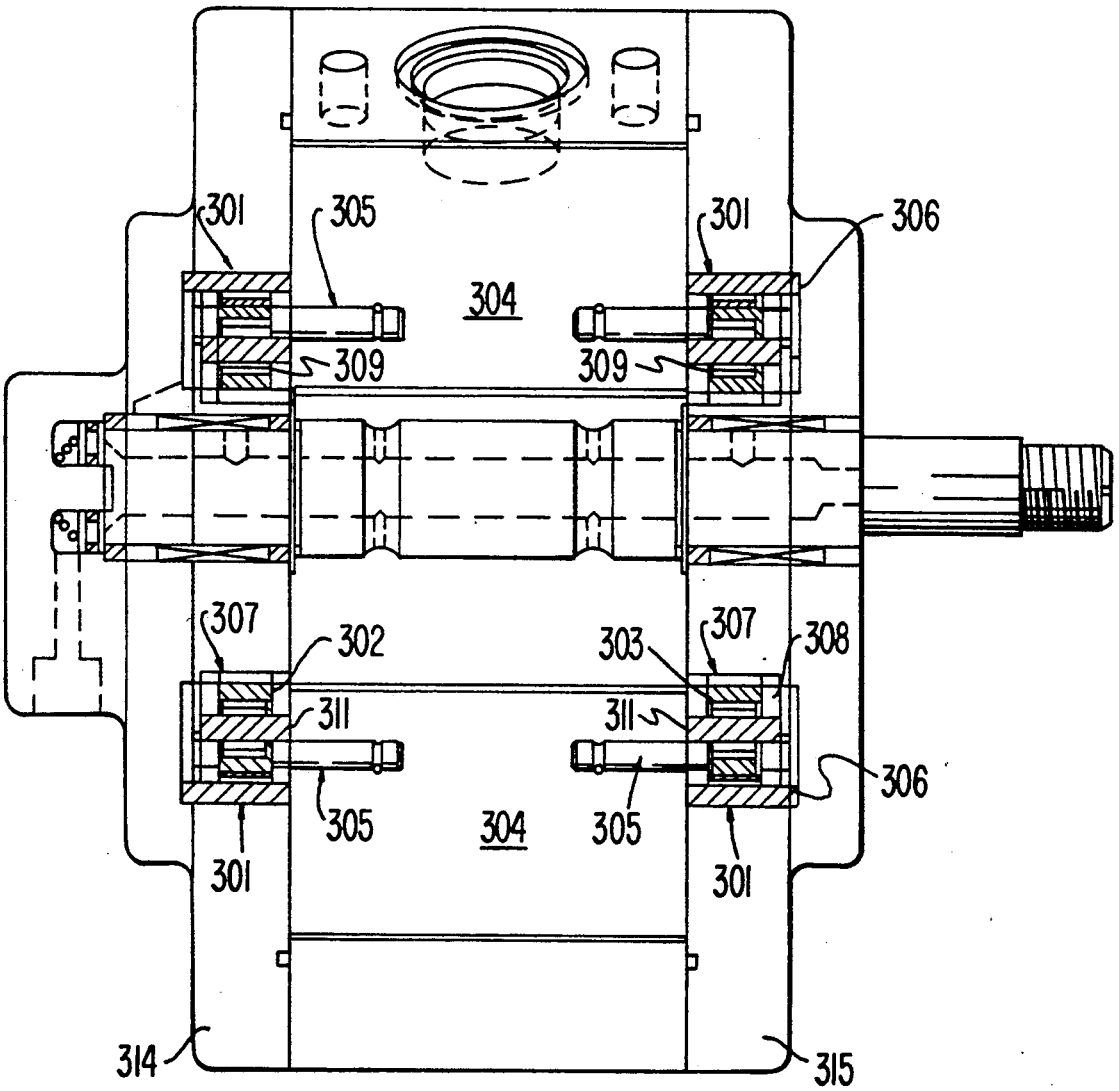
FIG. 6B is a view similar to FIG. 2 in connection with the embodiment of FIG. 6A.
Figure 6C:
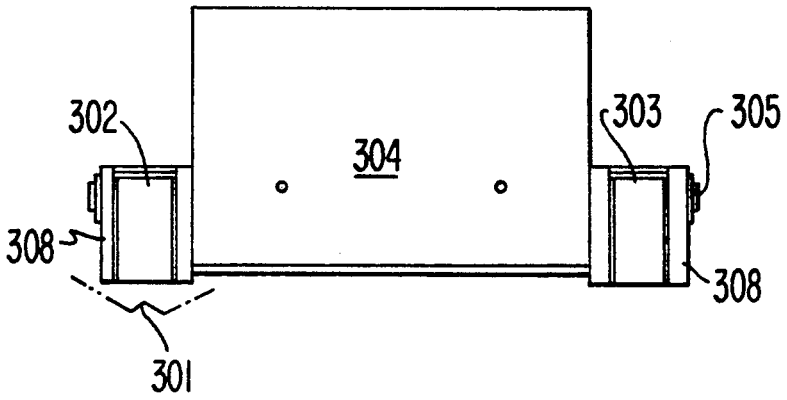
FIG. 6C is a break out or isolated side view of the twin roller tether-equipped vane shown in FIG. 6A.
Figure 6D:
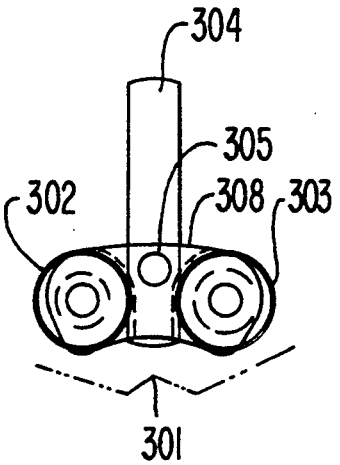
FIG. 6D is a side view of the vane shown in FIG. 6C.
Figure 6E:
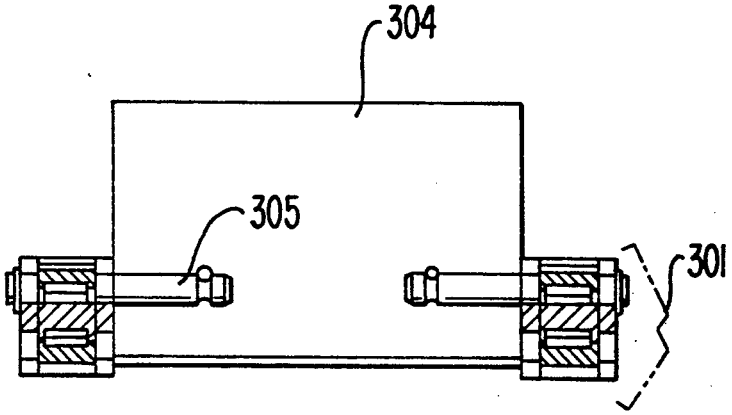
FIG. 6E is a view similar to FIG. 6C but with the twin roller assemblies shown in cross-section.

FIGS. 6A and 6B show the twin roller tether arrangements 301 within the compressor 300 looking at the face on front and from the side, respectively. The outer tether race 306 and inner hub surface 307 contain the twin roller vane tether assemblies 301. As seen in FIG. 6B, the assemblies 301 are arranged at both sides of the vanes 304 by way of the vane tether pins 305 as above noted. In the magnified showing of the assembly 301 in FIG. 6C, the tether frame 308 houses the two identical rollers 302, 302 provided with conventional anti-friction bearings 309 which engage an inner diameter 310 region of the identically constructed rollers 302, 303 and with an axle stub 311 which holds the rollers rotatably within the frame 308. The assembly 301 is sized such that the outer diameter of the twin rollers 302, 303 protrudes slightly above the radial surface 312 of the frame 308. As a result of vane action, the outward radial forces exerted on the tether pins 305 shown in FIG. 6B are transmitted to the frame 308 and the vane 304, and thereafter are transmitted to the rollers 302, 303 via the axle stubs 311 and associated anti-friction bearings 309. These forces extend to the outer annular races 306 which are located within the opposing endplates 314, 315 of the compressor 300 as shown in FIG. 6B.

The inner radial surface 316 of the dual roller tether frame 308 is dimensioned to just clear the inner hub surface 307 of the annular grooves located within the endplates 314, 315. Therefore, in the event that inward radial forces tend to push the vane 304 inwardly, this inward motion will be effectively controlled at that interface 307, 316, thereby maintaining effective machine operation because the vanes 304 retain sealing action.

This embodiment has the advantage of being amenable to precise manufacture and reliability analysis, although it is somewhat more complex and expensive to produce. Furthermore, it provides positive biaxial vane motion control.

FIGS. 1 and 4*a*–4*f* described in detail above use roller bearings that are caged or retained in a conventional manner, albeit not used in a manner which had been previously known. Specifically, a multi-pocket arrangement captures individual bearing rollers for the purpose of holding them loosely in place, and also preventing them from rubbing against each other as in the case of a full compliment roller bearing. Such roller retainers, while preventing counter-rotational intraroller contact and rubbing, are nonetheless subject themselves to the direct rubbing of each of the caged rollers.

Analysis of the action of the anti-friction van tether bearing reveals that, due to the cyclic variation in tether velocity arising from the rotor eccentricity (i.e., vertical offset), each conventionally-retained roller experiences, on average, about one-fourth of its total motion as sliding motion and the remaining three-fourths of total motion as pure rolling. This can be seen more readily if one considers that the radius of rotation of a roller towards the top of the compressor is smaller than the radius of rotation near the bottom as seen in FIG. 1. Since the rotor speed is nominally constant, a roller bearing appearing towards the top of the machine caged with roller near the bottom of the machine results in the higher velocity roller on the bottom being velocity retarded by the slower moving roller on the top of the machine and vice-versa at an angular location. While it is common for rollers to rub against each other, as pointed out above, a means by which sliding is minimized or even eliminated altogether is of great benefit.

Figure 7A:
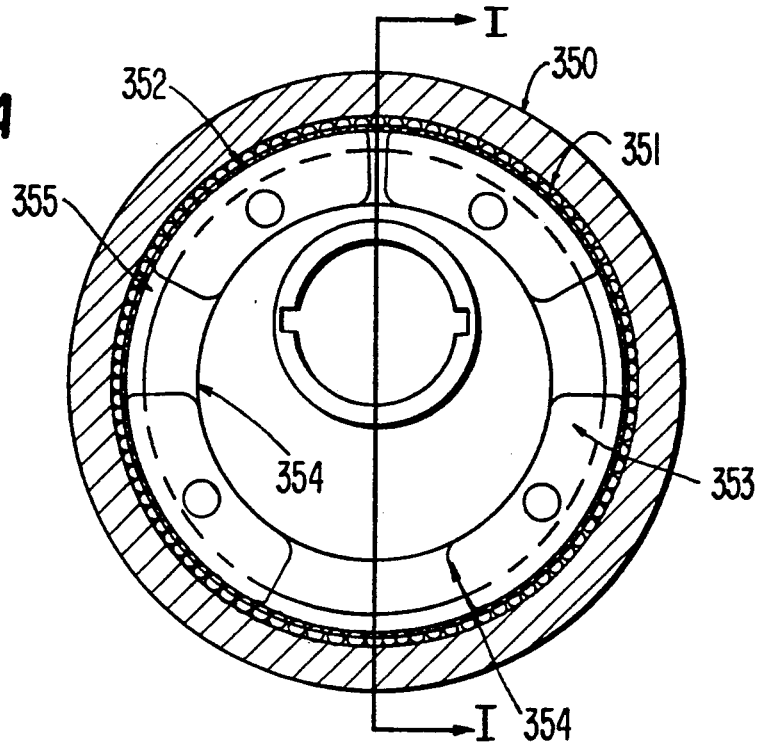
FIG. 7 is a partial cross-sectional elevational view similar to FIG. 1 of yet another embodiment of the present invention which utilizes a variable speed roller bearing retainer.
FIG. 7B is an isolated side view in cross-section taken along line I—I of the arrangement of the retained rollers, vane tethers, the outer bearing channel race, roller bearings and central internal limiting retainer ring in the left end plate of the embodiment of FIG. 7A.
FIG. 7C is a break out or isolated magnified front view of a portion of the freely rotating bearing assembly shown in FIGS. 7A and 7B.
FIG. 7D is a partial cross-sectional magnified side view of the portion of the assembly shown in FIG. 7C.
FIG. 7E is a front view of the freely rotating bearing outer channel race of the assembly shown in FIGS. 7A-7D.
FIG. 7F is a cross-sectional view along line II—II in FIG. 7E.
FIG. 7G is a side view of the central internal retainer ring for the assembly shown in FIGS. 7A-7D.
FIG. 7H is a front view of the ring shown in FIG. 7G.
Figure 7B:
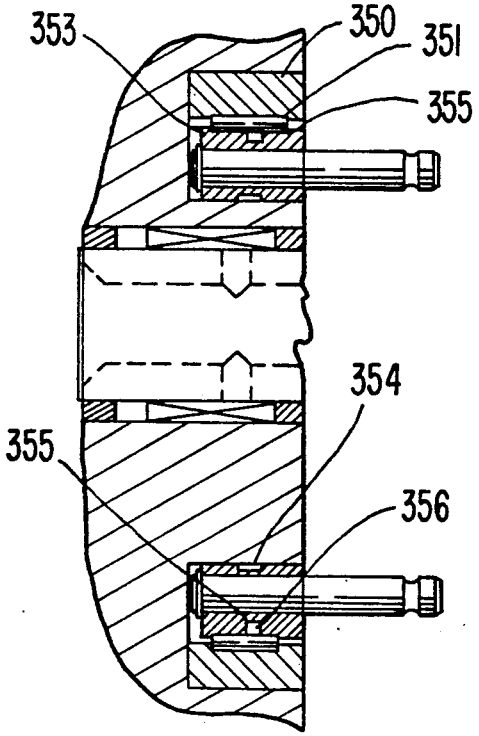
Figure 7C:
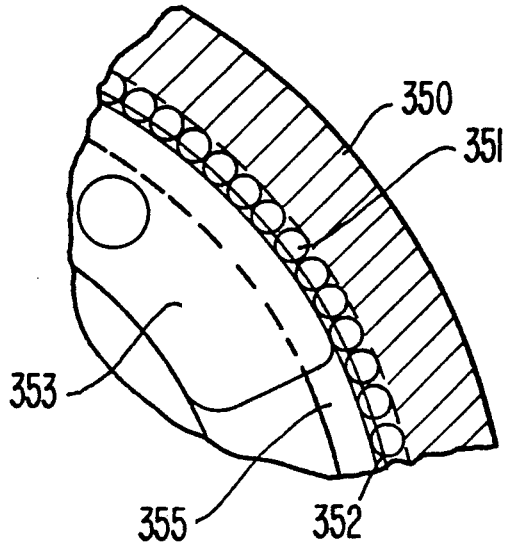
Figure 7D:
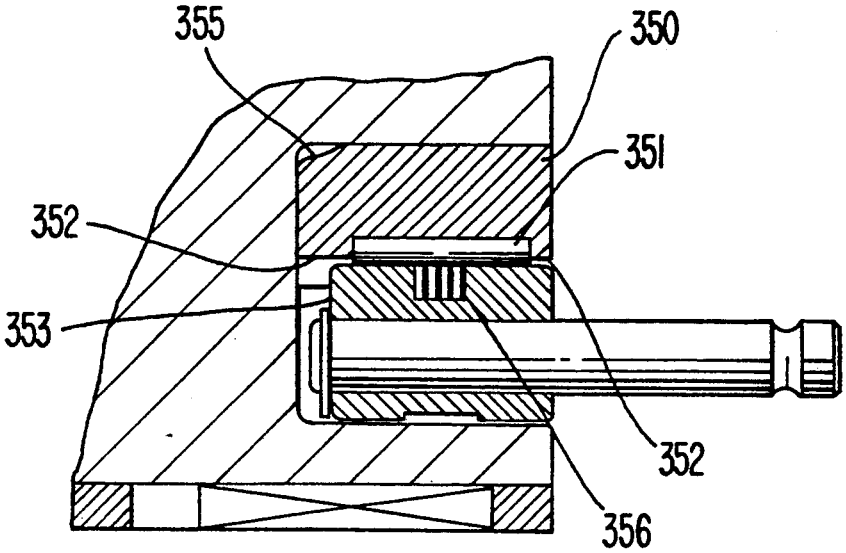
Figure 7E:
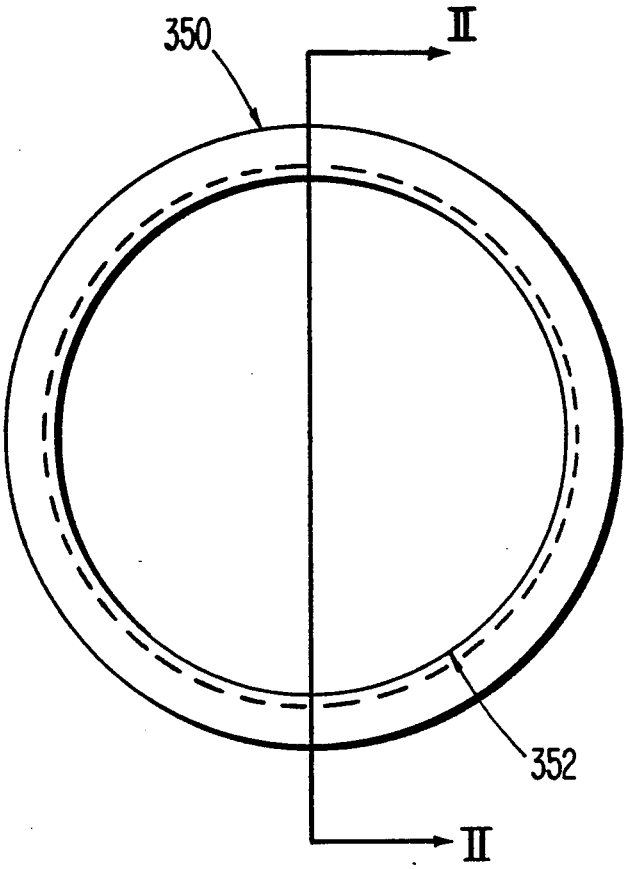
Figure 7F:
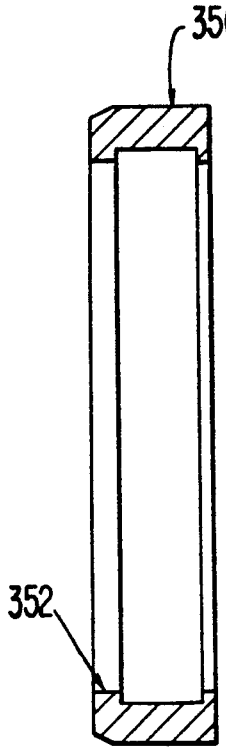

An embodiment for achieving such a benefit is shown in FIGS. 7A–7H wherein a variable speed roller bearing retainer is utilized. FIGS. 7A and 7B show the placement of the retained rollers, the vane tethers, the outer roller bearing channel race, roller bearings, and the central internal limiting retainer ring in the face and side views, respectively, similar to the embodiment shown in FIGS. 1 and 2 but without vanes being shown for case of illustration.

Referring specifically now to FIG. 7A, the cross-section of the freely rotating bearing (FRB) roller channel race 350 is seen to contain a set of plain cylindrical roller bearings 351 within the channel section of the bearing race. Bearing end barricades (which form the side of the channel race) are represented by circular line 352 and serve to limit the axial motion of the roller elements. In sequence, the vane tethers 353 ride directly against the minimally-exposed bearing elements 351 residing within the channel of the FRB bearing race.

During normal operation, the inner radius of the vane tethers 353 just radially clears the internal hub surface 354 by a small distance, e.g. on the order of 0.001 inch. Although centrifugal forces will tend to have the anti-friction roller bearings 351 nestle within the channel of the FRB channel race, transient, start-up and vibratory motions can disrupt the location of these bearings. Such a disruption can lead to catastrophic machine failure. The purpose of the central internal roller retainer ring 355 is, therefore, to eliminate this eventuality This internal retainer ring 355 shown in FIGS. 7G and 7H resides within the central channels 356 of the vane tethers 353, and thus provides a continuity of inner radial force against each bearing roller element 351 that spans across the circumferential voids between the trailing and leading edges of each of the vane tethers 353. Other physical placements of this ring are clearly possible, e.g. baton-shaped rollers with the retainer ring residing in roller handles, without departing from the scope of the present invention.

The above-described embodiment assure that the roller bearings 351 maintain their radial location without fear of them falling out of place within the compressor. A somewhat more subtle role is also played by this internal retainer ring 355. The roller bearing elements 351 will tend to spread out as they travel from the top vertical location to the bottom vertical location (assuming clockwise rotation). Sequentially, as in a mirror image, the roller bearings 351 will tend to regroup during the subsequent half rotation from the vertical bottom of the compressor to the vertical top. Because ideal mechanical motion is generally rolling motion, it can be seen that the internal retainer ring 355 has the secondary effect of not only providing radial roller element location, but of also keeping the roller bearings 351 separated. This secondary effect eliminates counter-rotating roller rubbing associated with conventional full compliment bearings, and also allows, to a very high degree, for the proper maintenance of the angular or peripheral spacing of the roller bearings 351.

Figure 7G:
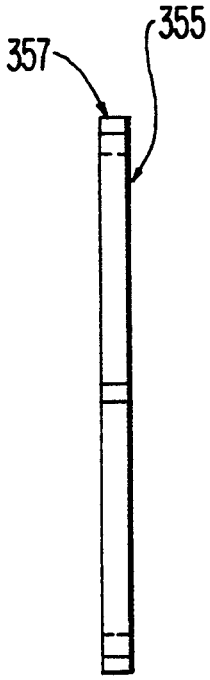
Figure 7H:
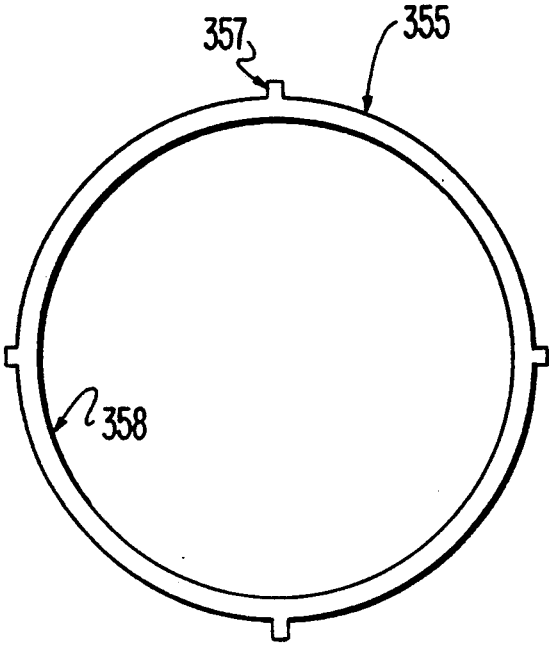

Referring now to FIGS. 7G and 7H, radial protrusions 357 can extend from the outer radius 358 of the internal roller retainer ring 355. These optional protrusions do not exist in the central radial retainer ring 355 shown in FIG. 7A but provide for further and more specific grouping of a quadrant-set of roller bearings 351. These four retainer protrusions 357 guarantee that under no circumstance will a minimum compliment FRB roller assembly ever reach a condition in which the vane tethers would lose sufficient roller bearing support for misoperation or failure of the compressor. A minimum bearing compliment is desirable because, ideally, such a minimum number of rollers will entirely eliminate any component of sliding roller motion.

By dividing the roller compliment into four equal groups, as shown in FIGS. 7G and 7H for illustrative purposes, this segregating internal roller retainer ring 355 imposes only about 10% sliding motion on the total roller motion. The remaining 90% is pure rolling motion. Of extreme importance is the consideration of limiting the rotor/tether speed. A full compliment roller bearing is subject to low limiting speed. This limitation is such that, were a full compliment of bearings 351 used in FIG. 7A, the theoretical limiting rotor speed would by only 1250 RPM. This low limiting speed is due to the above-discussed counter-rotational rubbing of adjacent rollers.

Referring again to FIG. 7A, it can be seen that the natural roller tendency is to separate from the top vertical to the bottom vertical (again assuming clockwise rotor rotation). Conversely, during the return half rotation, the roller elements 351 tend to regather. In other words, a full compliment bearing of the conventional type remains limited as a full compliment bearing even if one or more roller elements 351 are removed. Even though a gap develops, the remaining bearings will all rub against each other. With the ring 355 of the present invention shown in FIGS. 7G and 7H, the counter-rotational roller element contact and rubbing due to natural rolling element separation are eliminated. Therefore, employing the inner FRB retainer ring 355 will further tend to protect the roller elements from counter rotational rubbing. This simple, but important feature increases by a factor of more than ten the natural limiting speed of the rotor-tether assemblies. This large increase in limiting speed is extremely important in any commercial compressor herein.

With reference to the compressor embodiment designated generally by the numeral 400 in FIG. 8, manufacturability can be maximized by minimizing the number of parts and by having the parts consist only of planar and cylindrical surfaces. Making the parts planar or circular, while at the same time achieving high energy efficiency by maintaining sealing non-contact vane tip/-stator engagement, is made herewith much less difficult.

Figure 9A:
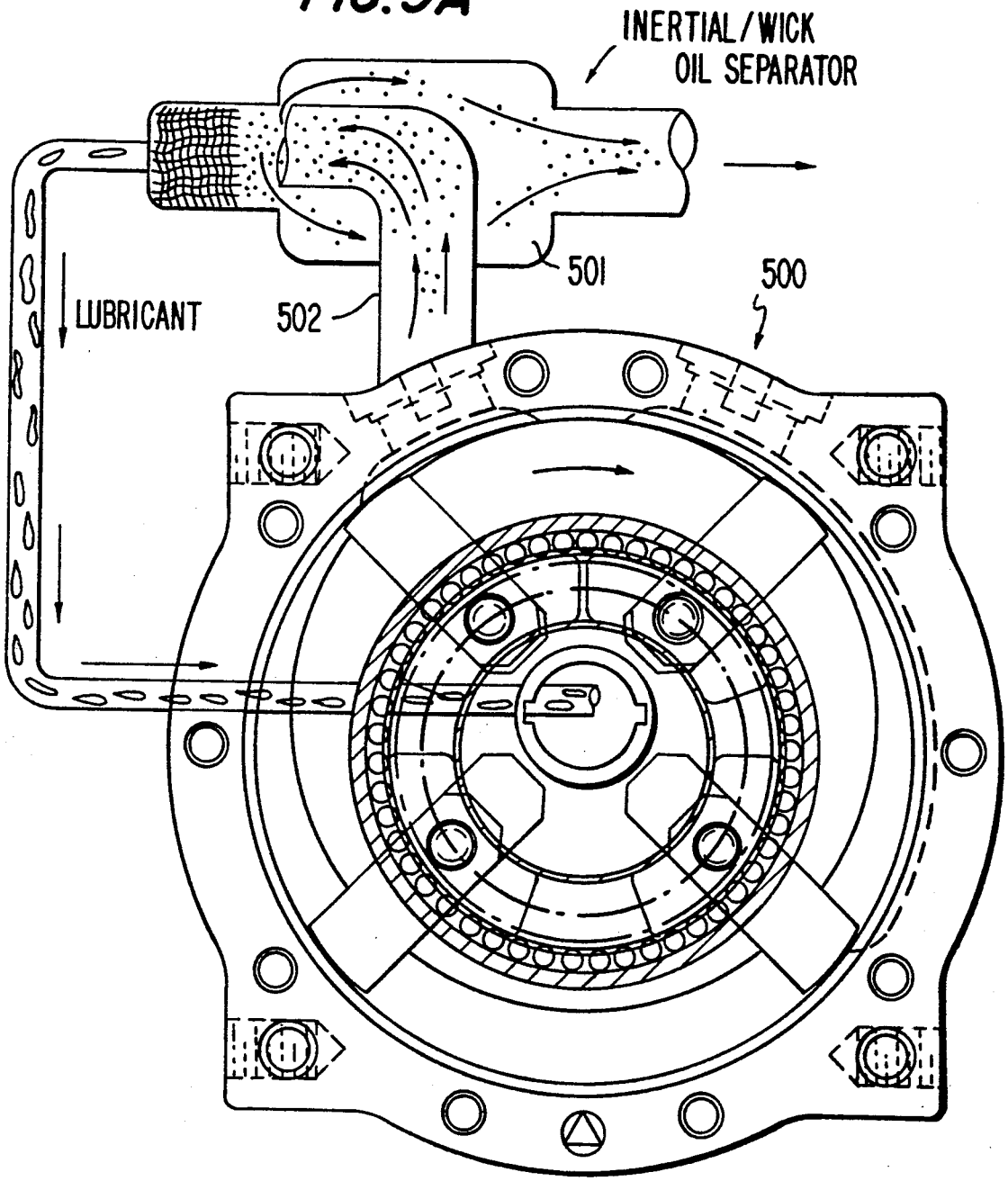
FIG. 9A is a view similar to FIG. 1 but showing a compressor configuration with an oil separator in the discharge line and the return oil passages.
Figure 9B:
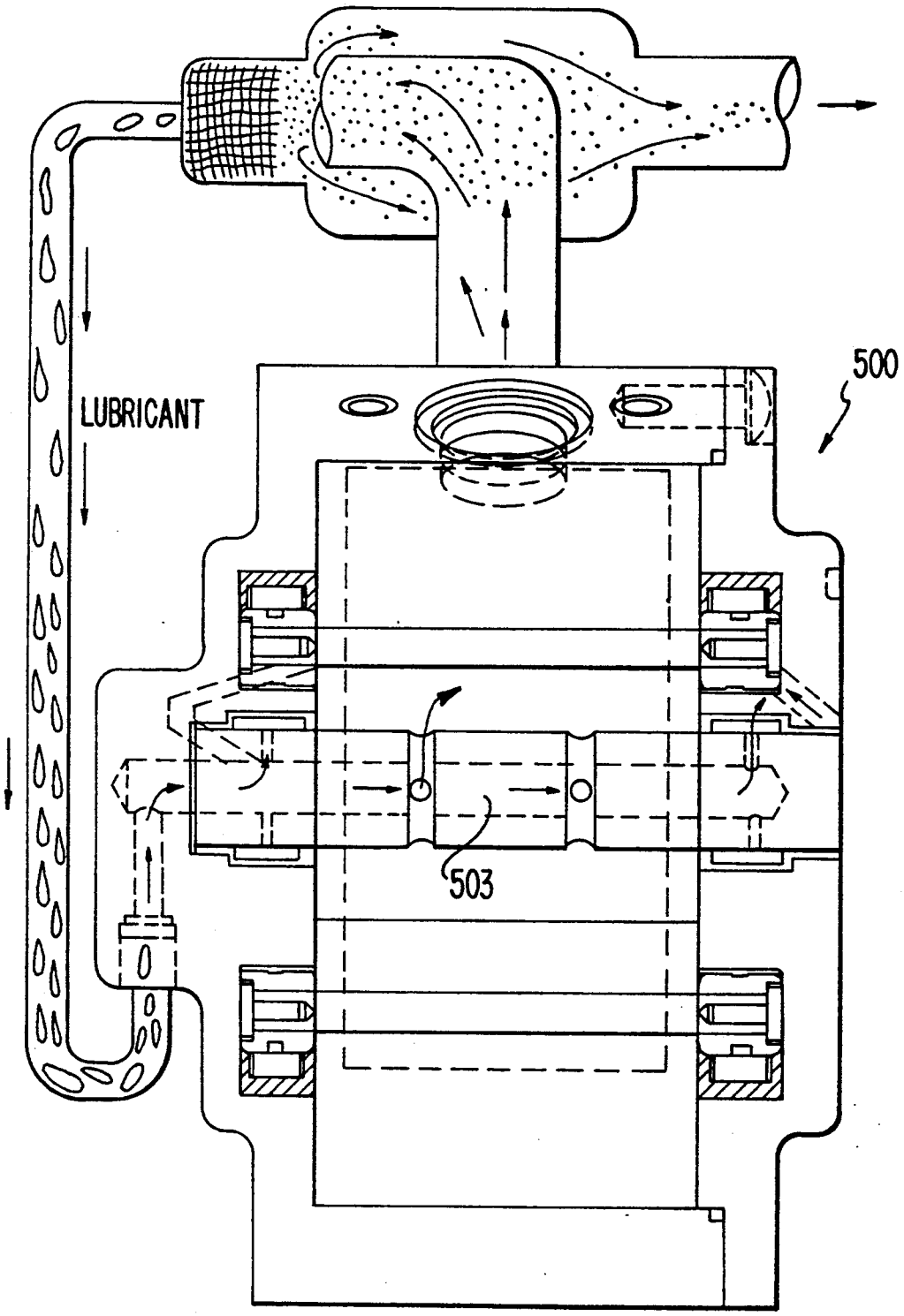
FIG. 9B is a side partial cross-sectional view of the compressor, oil separator and return oil passages shown in FIG. 9A.

FIGS. 9A and 9B show a compressor 500 with an oil separator 501 in the discharge line 502. This oil separator 501 supplies high pressure oil that is routed to the rear of the compressor 500 where it flows into the rotor shaft hole 503 and on into the innards of the machine. This type of oiling system is very positive, but requires the expense of an oil separator.

Figure 10A:
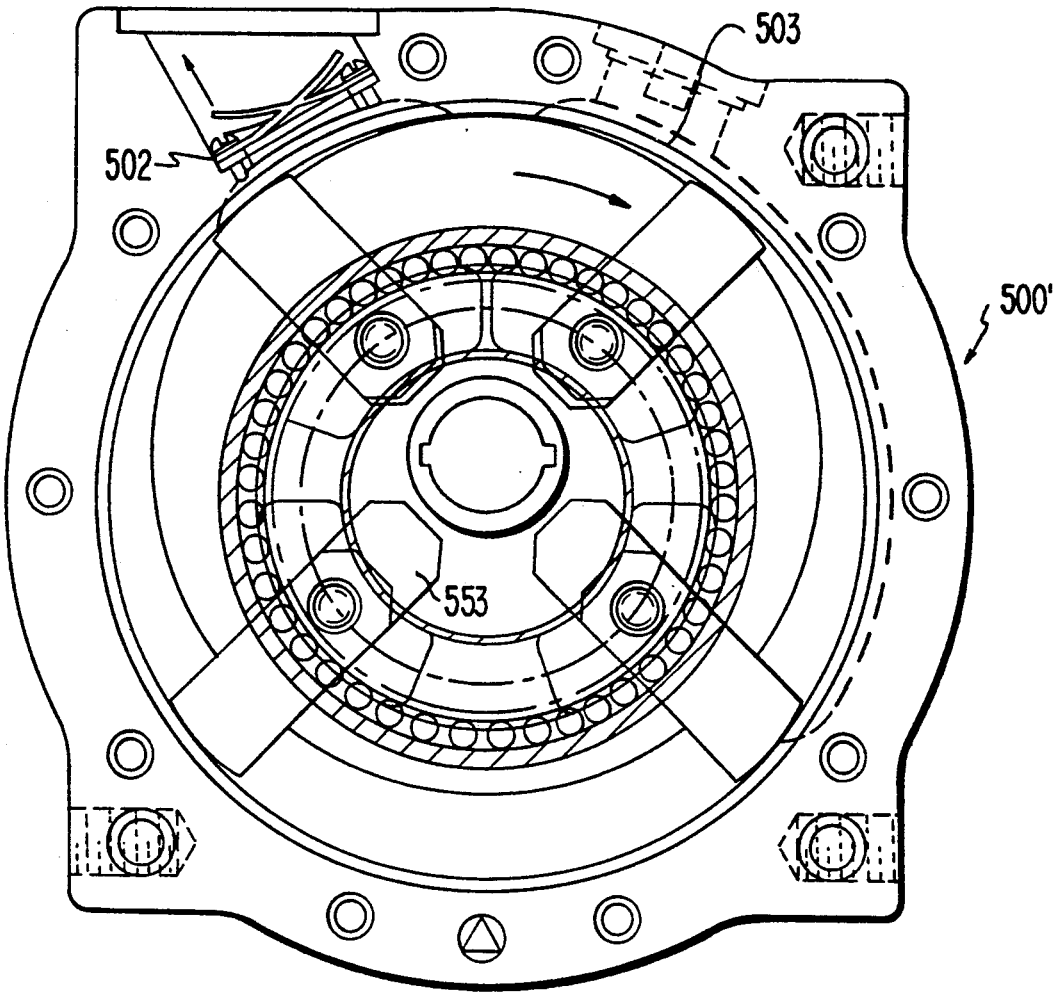
FIG. 10A is a view similar to FIG. 9A but of yet another embodiment of a compressor but with discharge reed valves.
Figure 10B:
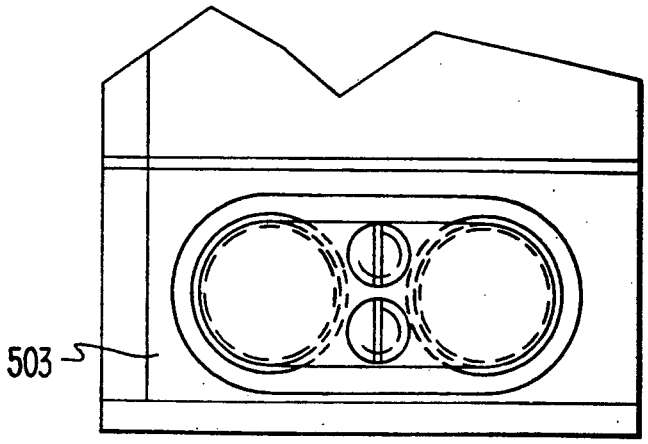
FIG. 10B is a break out or isolated magnified view of a portion of the compressor viewed in the direction of arrow A in FIG. 10A.
Figure 10C:
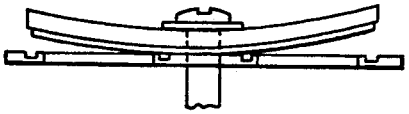
FIG. 10C is a side view of the reed valves shown in FIG. 10B but in a raised exhaust position.

A discharge valve, while incurring further expense, assures lower noise and better operating efficiency over a larger operating range of temperatures. FIGS. 10A through 10C show the basic compressor 500 of FIGS. 9A and 9B but with the compressor discharge valve 502, 503 of known construction and operation to achieve the noise reduction and increased operating efficiency.

Figure 11A:
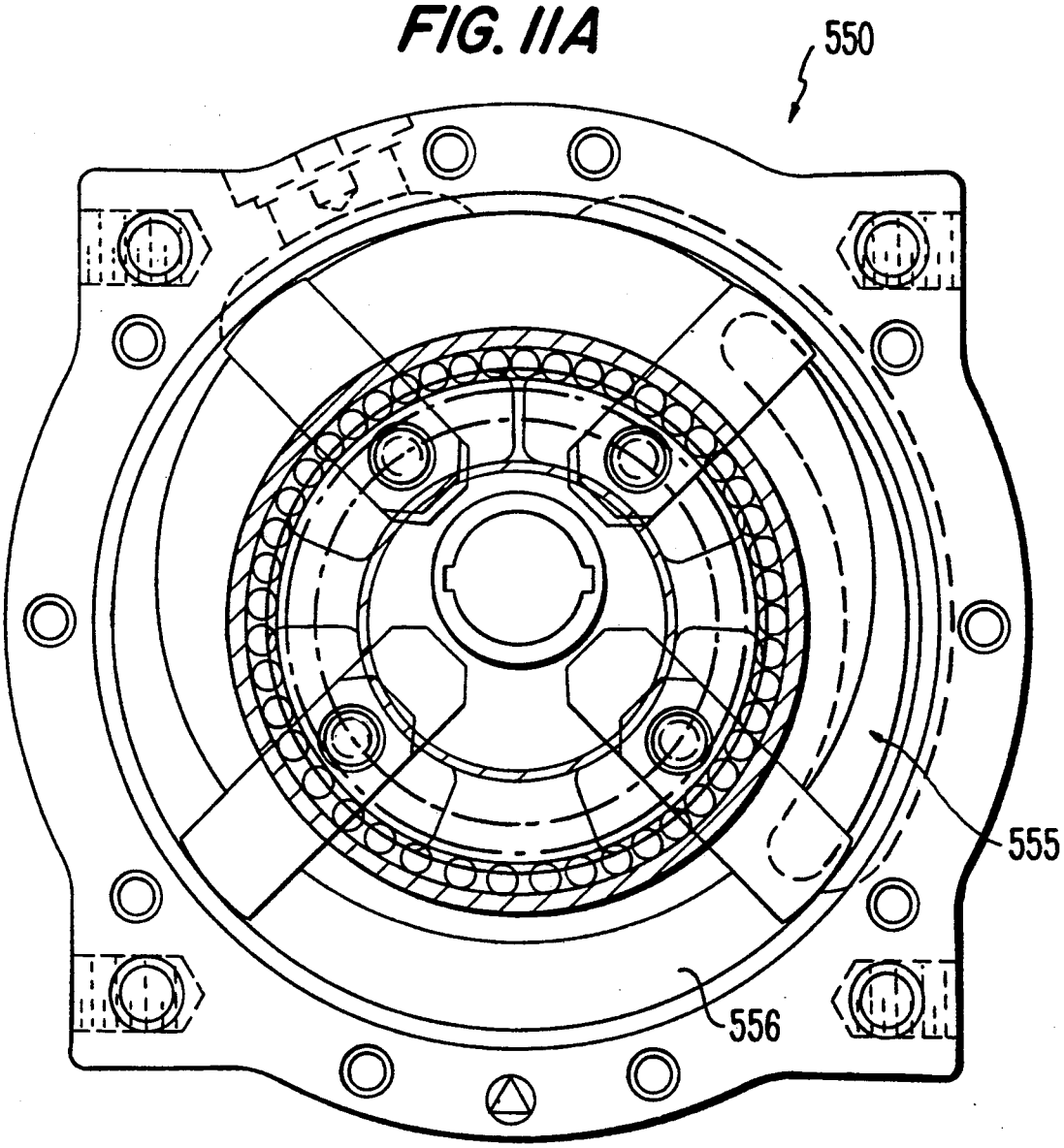
FIG. 11A is a view similar to FIG. 9A but of a compressor embodiment which uses a volunteer oil induction system.
Figure 11B:
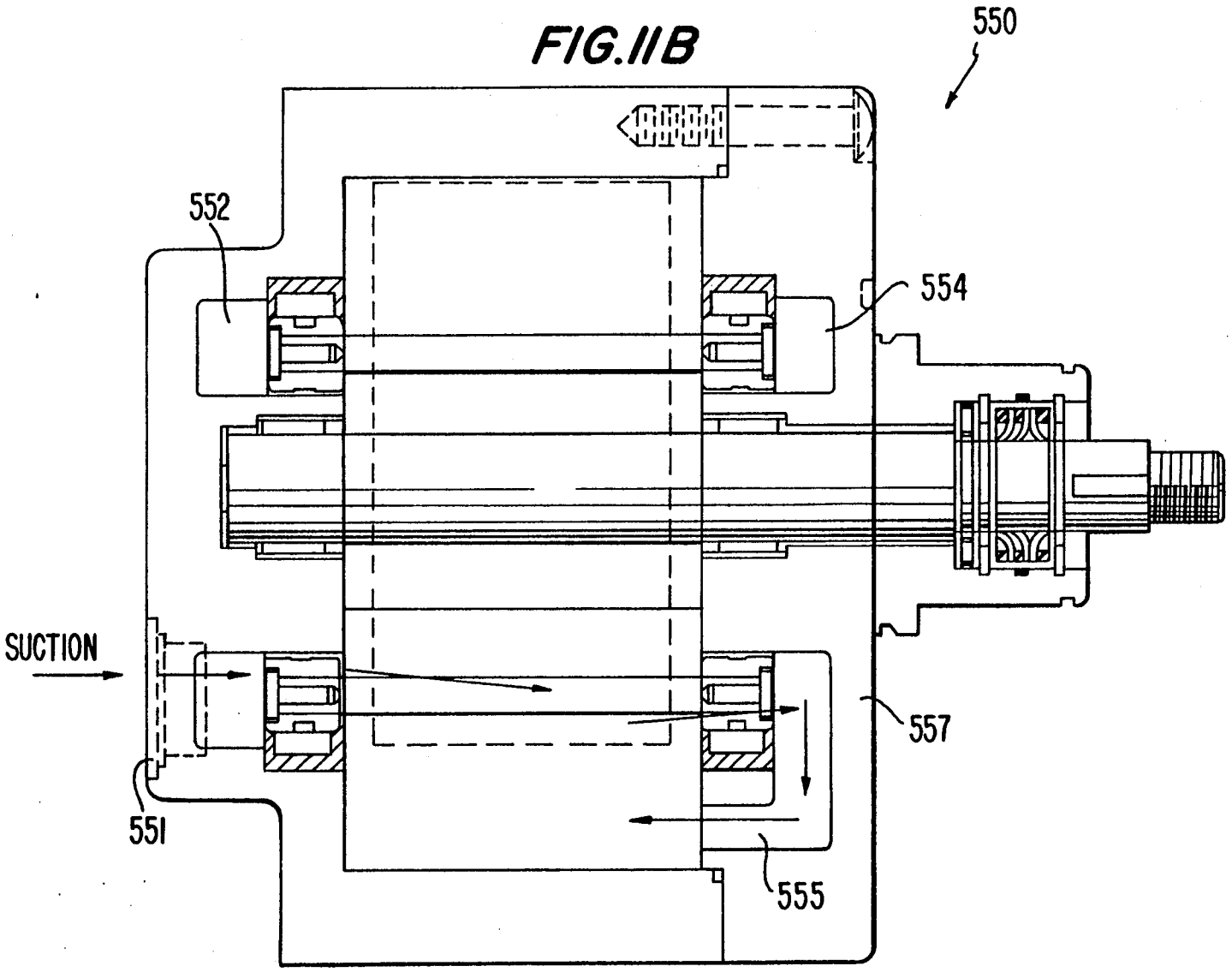
FIG. 11B is a side view similar to FIG. 9B but of the compressor shown in FIG. 11A.

A "volunteer" oiling system as shown in the refrigerant compressor 500 of FIGS. 11A and 11B depends upon the returning oil from the evaporator outlet. In this configuration, no oil separator is required as in FIGS. 9A and 9B. The returning oil is put in the system and circulates continuously around the entire refrigerant loop. It returns with suction gas to the compressor inlet 551 as shown in FIG. 11B. This oil then passes through the machine and provides lubrication to all the internal parts. The returning refrigerant gas, laden with lubricant, first enters the axial suction port 551, spreads around inside the extension of the rear vane guide annulus 552, flows axially through the open portions of the vane slots 553, and then gathers into the extension of the front vane guide annulus 554. Finally, this gas moves out radially to the "hot dog" slot 555 in the front endplate and then enters the main vane volume inlet segments 556. These embodiments show the single-piece endplate/stator (or stator cup) wherein the front endplate 557 is concentrically located within the bore of the stator.

Figure 12A:
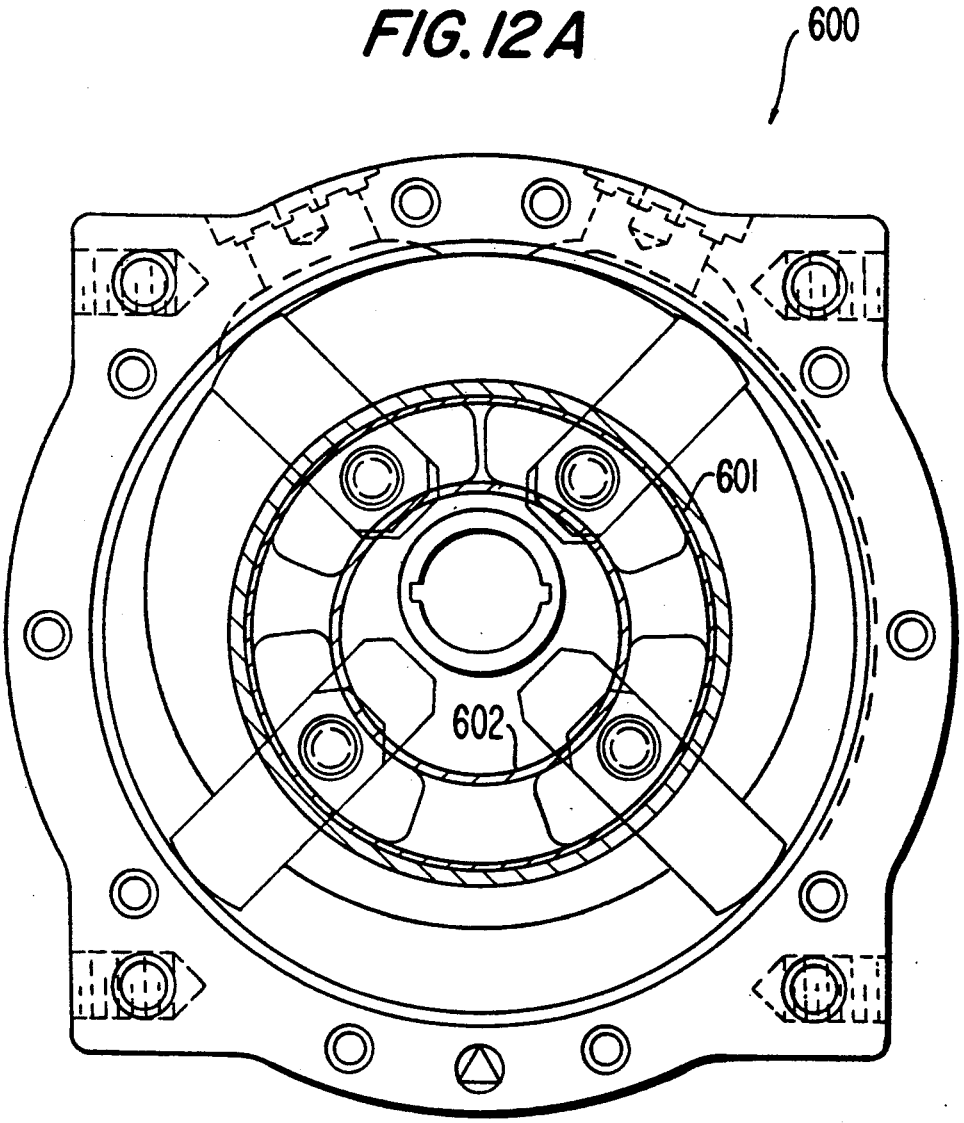
FIG. 12A is a view similar to FIG. 9B but of yet another embodiment of a compressor which utilizes a composite, vane tether/anti-friction ring interface.
Figure 12B:
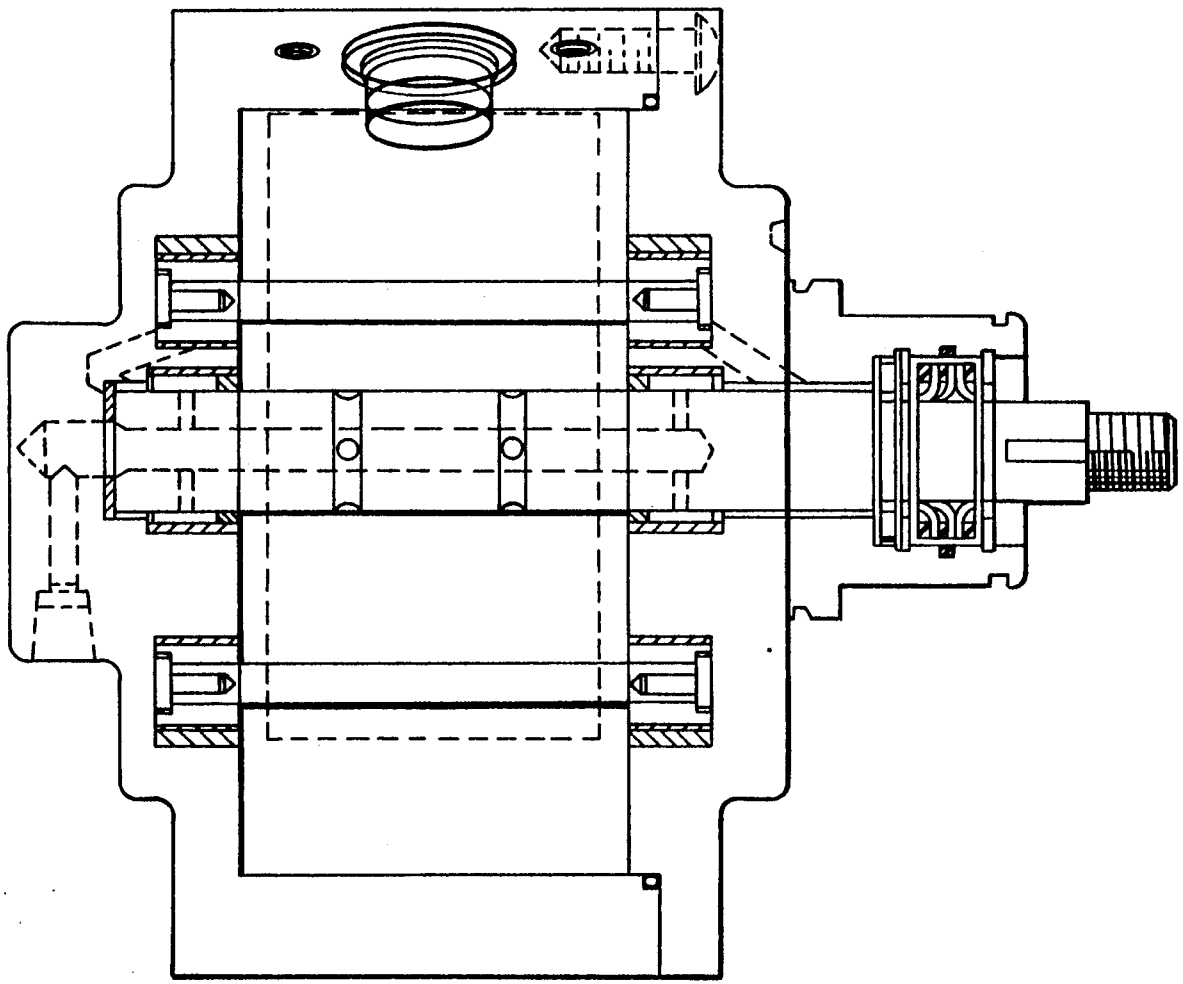
FIG. 12B is a view similar to FIG. 9B but showing the compressor in FIG. 12*a;*
Figure 12C:
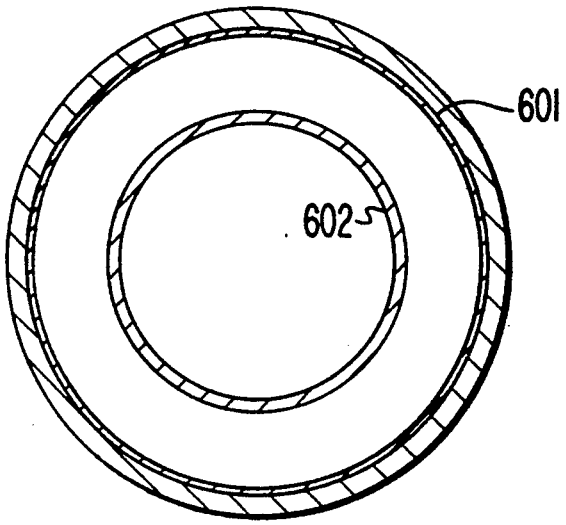
FIG. 12C is a break out or isolated view of the anti-friction assemblies shown in FIGS. 12A and 12B.
Figure 12D:
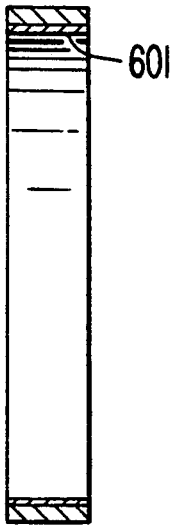
FIG. 12D is a side cross-sectional view of the outer ring of the assembly shown in FIG. 12C.
Figure 12E:
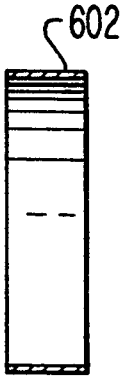
FIG. 12E is a side cross-sectional view of the inner ring of the assembly shown in FIG. 12C.
Figure 12F:
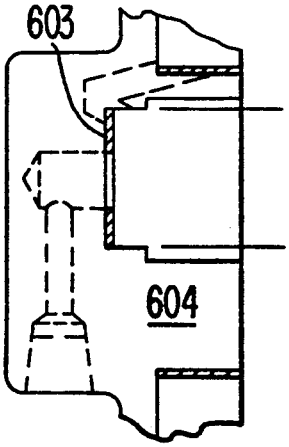
FIG. 12F is an isolated view of the portion of the rotor shaft shown in FIG. 12B showing a simple low friction thrust bearing.

In the compressor embodiment 600 shown in FIGS. 12A through 12F, low-friction sliding surfaces 601 and 602 are utilized. For example, "Perma-glide" material, which consists of a composite of Teflon, bronze, and lead can be used. Of course, many other types of materials, from carbon-graphite to babbitt or even well-finished steel or other materials, can be used with or without anti-friction coating. As shown in FIG. 12F, a low-friction thrust bearing 603 can be arranged in the endplate 604 to reduce rotating shaft friction while preventing leftward displacement of the shaft. The advantage of this particular glider annulus embodiment is, of course, simplicity. However, sliding friction, even if well lubricated, cannot, in general, deliver as low a friction as rolling motion. Nonetheless, for operating conditions where speeds and loads are moderate, this approach is of value. Also, when a non-liquid lubricated (i.e., "dry") machine is needed to, for example, compress air, this embodiment presents further advantages.

Figure 13A:
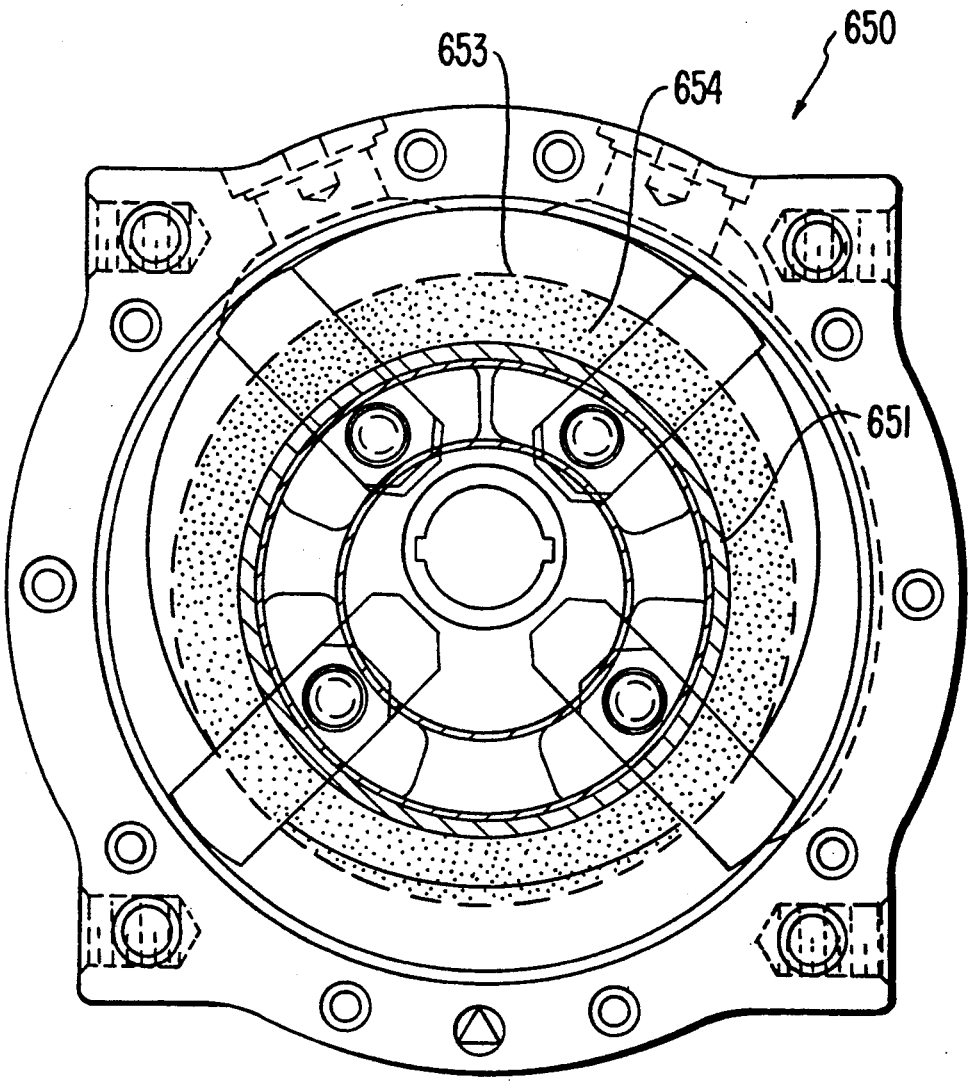
FIG. 13A is a view similar to FIG. 9A but showing a still further compressor embodiment of the present invention with a dry/semi-dry vane tether arrangement.
Figure 13B:
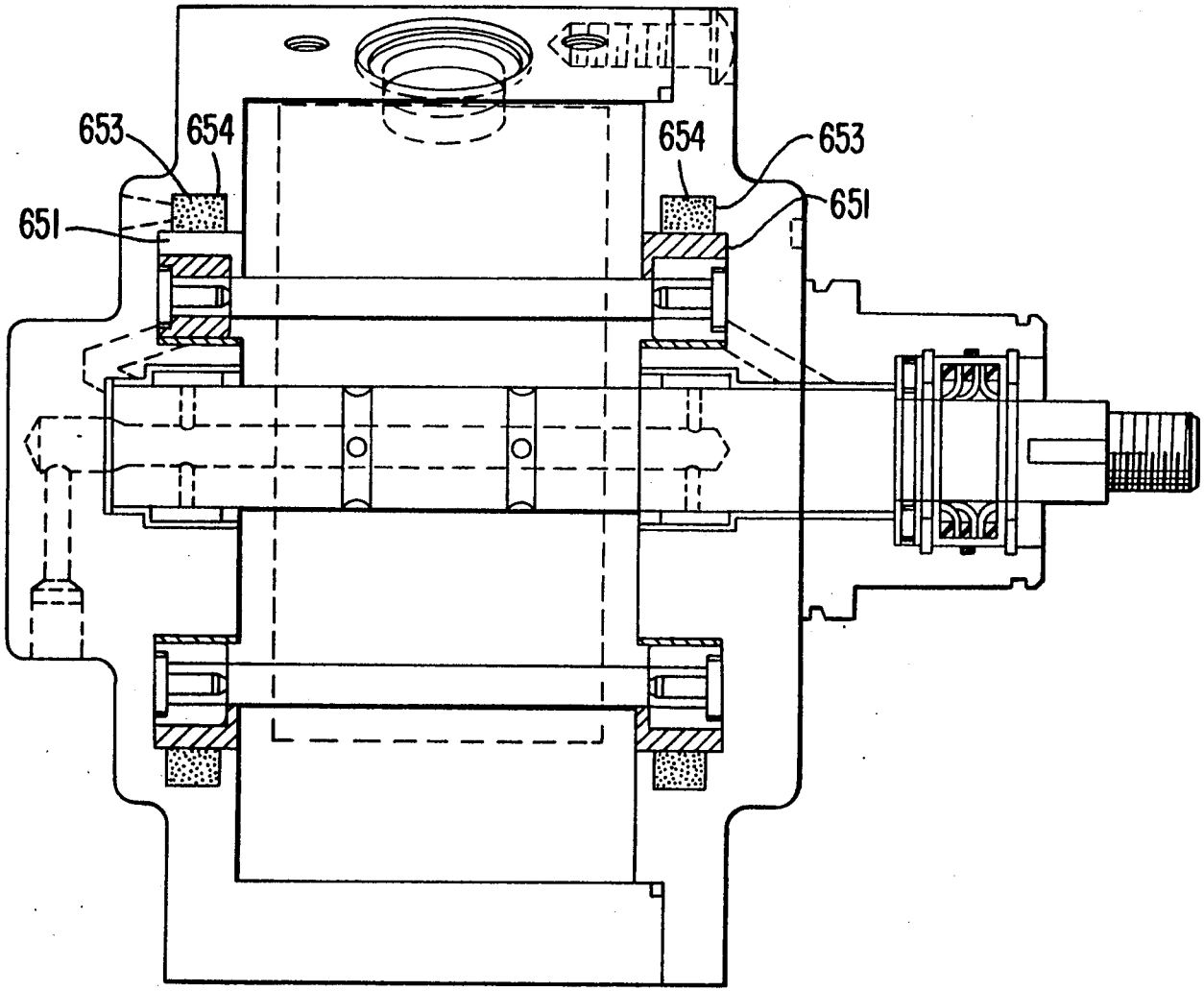
FIG. 13B is a side partial cross-sectional view of the compressor embodiment shown in FIG. 13A.
Figure 13C:
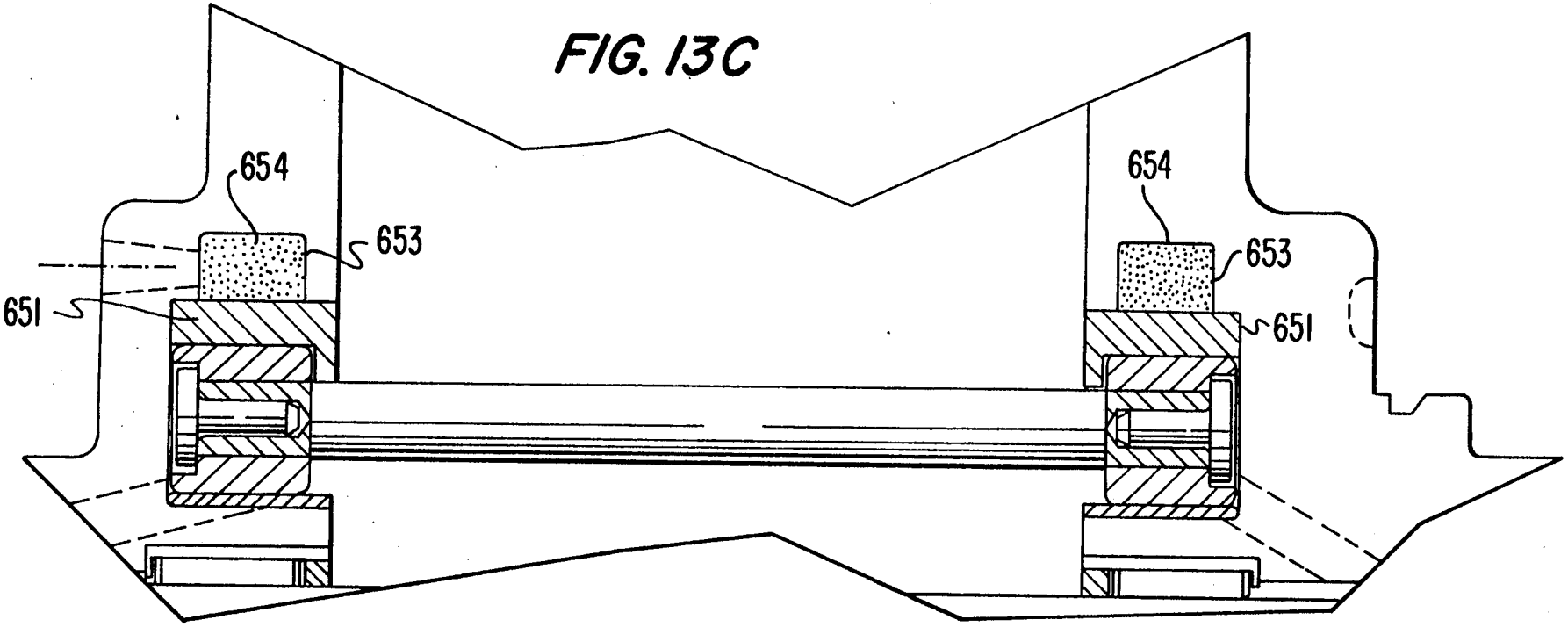
FIG. 13C is a break out or isolated, partial cross-sectional magnified view on a magnified scale, of the vane tether arrangements shown in FIG. 13B.

Another advantage my compressor offers is the ability to present a "semi-lubricated" embodiment 650 as shown in FIGS. 13A through 13C. The outside radial vane guide ring 651 can be made, for example, from a porous "self-lubricating" material such as powdered and sintered bronze (e.g."Oilite"). By further adding a secondary annular groove 653 surrounding the guide ring 651, an essentially permanent charge of lubricant (such as a moderate viscosity high surface tension grease) can supply lubrication when held in a wick matrix 654. This arrangement is practical primarily because the vane tether/anti-friction ring interface is protected within the channel of the race. The lubricant is confined to the region of interest by the groove 653 and wick 654, and simultaneously prevents the lubricant from entering other parts of the machine, thus keeping it "dry", but yet insuring long-term lubrication. The vanes can be made from usual materials now used in conventional dry rotary vane machines such as carbon-graphite materials.

The present invention can be embodied in ways other than those specifically described here, which were presented by way of non-limitative example only. For example, the machines described above as compressors can also be used in reverse as motors by introducing high pressure fluid into the compressor discharge port and exiting the fluid at the compressor inlet port. Thus, variations and modifications can be made without departing from the scope and spirit of the invention herein described which are to be constructed and limited only by the following appended claims.

I claim:

1. A non-contact vane-type motor comprising a casing having an interior conjugate internal conforming profile, said casing being secured between two opposing endplates and having an inlet for high pressure fluid and an outlet for the fluid, each endplate having a circular annulus, said annuli being of substantially matching configuration, the center of each annulus being coincident with the geometric center of said interior conjugate internal conforming casing profile, a rotor mounted for rotation within said casing in a matching eccentric relationship with said interior internal conjugate conforming casing profile, said rotor being equipped with at least one substantially radially disposed slot containing a vane having an accurately configured tip maintained in an exceedingly close but non-contact relationship with said interior conjugate internal conforming profile and a pivotally-mounted tether having inner and outer peripheries at a location comparatively remote from said vane tip, anti-friction rollers operatively disposed at at least one interface of each annulus and the respective vane tethers such that at least a portion of each of said tethers engages said anti-friction rollers during operation of said motor, the annulus in each of said endplates thus serving as an effective guide for the respective tethers and tips of said vanes.

2. The non-contact vane-type fluid displacement machine comprising a casing having an annulus at each end and a rotor having at least one vane with at least one substantially radially disposed slot, in each slot being contained a substantially rectangular vane having an accurately configured tip maintained in an exceedingly close but non-contact relationship with said conjugate internal conforming profile of said casing, each end of each vane being equipped with a pivotally-mounted tether at a location comparatively remote from a tip of said vane, with said vane tether having inner and outer peripheries, anti-friction rollers are operatively disposed at at least one interface of each annulus and the vane tether such that at least a portion of each of said tether directly engages said anti-friction rollers during operation of said machine, each annulus configured as an effective guide for the respective tether of said at least one vane and, therefore, for the tip of said at least one vane, said vane tip thus being caused to remain in an exceedingly close yet substantially frictionless relationship with an internal contour of said casing.

3. In the non-contact vane-type fluid displacement machine in accordance with claim 2, wherein a single vane is associated with said rotor.

4. In the non-contact vane-type fluid displacement machine in accordance with claim 2, wherein a pair of vanes are associated with said rotor and are disposed in a opposite relationship with regard to an axis of rotation of said rotor.

5. In the non-contact vane-type fluid displacement machine in accordance with claim 2, wherein at least three vanes are symmetrically disposed about an axis of rotation of said rotor.

6. In the non-contact vane-type fluid displacement machine in accordance with claim 2, wherein said anti-friction rollers are installed in each annulus.

7. In the non-contact vane-type fluid displacement machine in accordance with claim 2, wherein the periphery of said rotor is engaged sealingly within the internal casing contour at a region separating a zone of high pressure fluid from a zone of low pressure fluid within said machine.

8. In the non-contact vane-type fluid displacement machine in accordance with claim 2, wherein said anti-friction rollers are installed on the outer periphery of said tether.

9. In the non-contact vane-type fluid displacement machine in accordance with claim 8, wherein said anti-friction rollers are trunnioned bearings.

10. In the non-contact vane-type fluid displacement machine in accordance with claim 8, wherein said anti-friction rollers are freely-rotating caged roller bearings.

11. In the non-contact vane-type fluid displacement machine in accordance with claim 2, wherein said anti-friction rollers are operatively arranged on the inner periphery of said tether.

12. In the non-contact vane-type fluid displacement machine in accordance with claim 11, wherein said anti-friction rollers are trunnioned bearings.

13. In the non-contact vane-type fluid displacement machine in accordance with claim 11, wherein said anti-friction rollers are freely-rotating caged roller bearings.

14. In the non-contact vane-type fluid displacement machine in accordance with claim 2, wherein said anti-friction rollers are operatively arranged on the inner and the outer peripheries of said tether.

15. In the non-contact vane-type fluid displacement machine in accordance with claim 14, wherein said inner anti-friction rollers installed at said inner periphery are freely-rotating caged roller bearings, and the outer anti-friction rollers installed at said outer periphery are trunnioned roller bearings.

16. In the non-contact vane-type fluid displacement machine in accordance with claim 14, wherein said anti-friction rollers are freely-rotating caged roller bearings.

17. In the non-contact vane-type fluid displacement machine in accordance with claim 14, wherein said anti-friction rollers installed on said inner periphery and said outer periphery are trunnioned roller bearings.

18. In the non-contact vane-type fluid displacement machine in accordance with claim 2, wherein said anti-friction rollers directly engage both the inner and the outer periphery, with said anti-friction rollers comprising freely-rotating caged roller bearings being utilized on the outer periphery, and said anti-friction rollers comprising trunnioned bearings on the inner periphery.

19. In the non-contact vane-type fluid displacement machine in accordance with claim 2, wherein at least one of the peripheral surfaces of each annulus is fitted with separate hardened precision races to accommodate the bearing loads exerted by said vane tethers.

20. In the non-contact vane-type fluid displacement machine in accordance with claim 2, wherein a small distance is maintained between the inner tether periphery and the inner periphery of each annulus, said small distance providing inward radial slack in the radial position of said vane in order to provide a purposeful leakage path between said vane tip and said internal casing contour for said compressed fluid in the event of inadvertently high pressure development inside said machine.

21. In the non-contact vane-type fluid displacement machine in accordance with claim 2, wherein a combination comprising said rotor, casing, at least one vane and a seal region between said rotor periphery and internal casing contour comprises one of a fluid compressor and a pump wherein a fluid chamber is formed within said casing, rotor periphery, said at least one vane, said seal region, and said endplates such that, said rotor rotates, said chamber undergoes volume change so that when fluid enters said machine through an inlet passage, said fluid undergoes pumping or compression and is discharged through a discharge passage at elevated pressure.

22. The non-contact vane-type fluid displacement machine according to claim 2, wherein the conjugate internal conforming profile is defined in accordance with the following relationships:

(a) Cartesian coordinates of a center of a pivotal-mounting pin of the vane tether as measured from the coincident center $O_s$ of the conjugate internal conforming profile and the annuli are $$xg=Rg[cos(Ar)]$$

$$yg=Rg[sin(Ar[];$$

(b) Angle Ag of a line from the rotor center through a center $P_P$ of the vane tether pin and through a center Pvtc of the vane tip radius as measured from the horizontal rotor axis is $$Ag=atan[yg/xg];$$

(c) Radius Rp from rotor center to a center of the vane tether pin is $$Rp=sprt[xg\quad 2+yg\quad 2];$$

(d) Radius Rtc from the rotor center to a center of the vane tip radius is $$Rtc=Rp+Rt;$$

(e) Cartesian coordinates of the vane tip radius center as measured from the center of the casing profile are $$xtc=Rtc[cos(Ar)]$$

$$ytc=Rtc[sin(Ar)]+e,$$

where e is rotor eccentricity defined as a difference between a vertical semi axis of the internal casing profile and the radius of the rotor;

(f) Angle at from casing center to the vane tip radius center as measured from the casing horizontal axis is $$at=atan[ytc/xtc];$$

(g) Radius Rtc from the casing profile center to the vane tip radius center is $$Rtc=sqrt[xct\quad 2+ytc\quad 2];$$

(h) Extended radial distance Rtt from the casing center of a corresponding point of tangency Pct between the vane tip and the conjugate internal conforming casing profile is $$Rtt = Rtc + rt; \text{ and}$$

(i) Cartesian Coordinates of a vane tip/casing wall tangency point Pvt are $$xtt = Rtt[\cos(t)]$$

$$ytt = Rtt[\sin(At)],$$

wherein angle At and the extended radial distance Rtt, define the polar coordinates of the conjugate internal conforming profile, and the Cartesian Coordinates of the conjugate internal conforming are defined in (i) above as a rotor/vane angle Ar as measured form the horizontal repeatedly incremented over 360 angular degrees.

23. The non-contact vane-type fluid displacement machine according to claim 1, wherein the conjugate internal conforming profile is configured so as to be other than truly circular and maintain the vane tip tangent to the profile at all angular positions of the vane.

24. The non-contact vane-type fluid displacement machine according to claim 23, wherein a small continuous gap on the order of 0.025 mm is maintained between the vane tip and the conjugate internal conforming profile.

25. The non-contact vane-type fluid displacement machine according to claim 2, wherein each said vane tether comprises a frame with curved upper and lower surfaces and two rollers bearing-mounted within the frame and sized such that outer diameters thereof protrude above the curved upper surface of the frame, and the curved lower surface of the frame is sized to just clear an inner surface of an associated one of the annuli in the endplates thereby providing positive biaxial vane motion control.

26. The non-contact vane-type fluid displacement machine according to claim 2, wherein the anti-friction means comprises a bearing channel outer race, a set of roller bearing elements operatively arranged between the outer surface and the associated tether, and an internal retainer ring operatively arranged with respect to the tethers to span a circumferential void defined between tracking and leading edges of adjacent tethers such that bearing elements will be retained between the outer surface and the associated tethers.

27. The non-contact vane-type fluid displacement machine according to claim 26, wherein the internal retainer ring is provided with radially extending and circumferentially spaced protrusions to define a specific grouping of the roller bearing elements.

28. The non-contact vane-type fluid displacement machine according to claim 2, wherein the conjugate internal conforming profile is a true circle when the vane tip center is coincident with the center of the pivotally-mounted tether and $$Rt = Rs - Rg$$

where Rt is a vane tip radius, Rg is the vane guide radius, and Rs is the circular casing radius.

29. The non-contact vane-type fluid displacement machine according to claim 2, wherein the machine is a compressor, and an oil separator is operatively operatively arranged in a discharge line of the compressor so as to provide high pressure oil within the casing to respective inside relatively moving surfaces of the compressor.

30. The non-contact vane-type fluid displacement machine according to claim 2, wherein the machine is a compressor and a valve is operatively arranged in a discharge port of the compressor to reduce noise and increase operating efficiency.

31. The non-contact vane-type fluid displacement machine according to claim 2, wherein the machine is a refrigerant compressor provided with closed-loop means for returning oil from an evaporator outlet to relatively moving surfaces inside the compressor via suction gas entering an inlet of the compressor.

32. A non-contact vane-type fluid displacement machine comprising a casing having around its interior, a conjugate internal conforming profile, said casing being secured between two opposing endplates, each endplate containing in its interior a circular annulus, said annuli being of substantially matching configuration, with each annulus having an inner and outer periphery, with the center of each annulus being coincident with the geometric center of said conjugate internal conforming profile, a rotor supported by said endplates and mounted for rotation in said interior of said casing in a matching eccentric relationship with said internal conjugate conforming casing profile, said rotor having end operationally disposed in a close fitting relationship with said opposing endplates, and said rotor being equipped with four symmetrically located vane slots, each slot containing a substantially rectangular vane, each vane having a circularly configured arc tip which is maintained is an exceedingly close but non-contact relationship with said conjugate internal conforming profile of said casing, each end of each vane being equipped with a pivotally-mounted tether at a location comparatively remote from said vane tip, each vane tether having inner and outer peripheries, the outer periphery of each of said vane tethers being equipped with trunnioned roller bearings, the trunnions of said trunnioned roller bearings being operatively associated within the outer peripheries of said vane tethers, said trunnioned roller bearings of said vane being rollingly engaged with the outer periphery of said annulus within said endplates, the inner periphery of said vane tethers engaging the inner periphery of said circular annulus contained within said endplates, the annulus in each of said endplates thus serving as an effective guide for the respective tethers of said vanes and, therefore, for the tips of said vanes, said vane tips thus being caused to remain in an exceedingly close yet substantially frictionless relationship with said internal conjugate contour of said casing.

33. The non-contact vane-type fluid displacement machine in accordance with claim 32, wherein the periphery of said rotor is engaged sealingly with the internal casing profile at a region separating a zone of high pressure fluid from a zone of low pressure within said machine.

34. The non-contact vane-type fluid displacement machine in accordance with claim 32, wherein a small distance is maintained between the inner peripheries of said vane tethers and the inner periphery of said annulus of said endplates, said small distance providing inward radial slack in the radial position of said vane in order to provide a purposeful leakage path between said vane tips and said conjugate internal conforming casing profile for said fluid in the event of inadvertently high pressure development inside said machine.

35. The non-contact vane-type fluid displacement machine in accordance with claim 32, wherein the combination of said endplates, rotor, casing, vanes, vane control means, and seal region between said rotor periphery and internal casing, comprise a gas compressor wherein chambers are formed within said casing, rotor periphery, two adjacent vanes, and two endplates, such that said rotor rotates, said chambers undergo significant volume changes so that when gas enters said machine through an inner passage, said gas undergoes compression and is discharged through a discharged passage a elevated pressure.

36. A non-contact vane-type fluid displacement machine comprising a casing having around its interior a conjugate internal conforming profile, said casing being secured between two opposing endplates, each endplate containing in its interior a circular annulus, said annuli being of substantially matching configuration, each annulus having an inner and outer periphery, the center of each annulus being coincident with the geometric center of said conjugate internal conforming profile, a rotor supported by said endplates and mounted for rotation in said interior of said casing in a matching eccentric relationship with said internal conjugate conforming profile, said rotor having ends operationally disposed in a close fitting relationship with said opposing endplates, said rotor being equipped with four symmetrically located vane slots, in each of which a substantially rectangular vane, each vane having a circularly configured arc tip which is maintained in an exceedingly close by non-contact relationship with said conjugate internal conforming profile of said casing, each end of each vane being equipped with a pivotally-mounted tether at a location comparatively remote from said vane tip, each said vane tether having inner and outer peripheries, a freely-rotating bearing being located within the outer periphery of each said endplate annuli such that the outer periphery of each of said vane tethers engages the outer periphery of said circular annuli in an anti-friction manner through the operation of said freely-rotating caged roller bearing being operatively disposed therebetween, the inner periphery of said vane tethers engaging the inner periphery of each said annulus, the annulus in each of said endplates thus serving as an effective guide for the respective tethers of said vanes and said freely-rotating caged roller bearings, and, therefore, for the tips of said vanes, said vane tips thus being caused to remain in an exceedingly close yet substantially frictionless relationship with said internal conjugate contour of said casing.

37. The non-contact vane-type fluid displacement machine in accordance with claim 36, wherein at least one of the peripheries of said annuli of said endplates is fitted with separate hardened precision races to accommodate the bearing loads exerted by the said vane tethers.

38. The non-contact vane-type fluid displacement machine in accordance with claim 36, wherein the periphery of said rotor is engaged sealingly with said stator casing at a region separating the zone of high pressure fluid from the zone of low pressure.

39. The non-contact vane-type fluid displacement machine in accordance with claim 36, wherein a small distance is maintained between the inner peripheries of said vane tethers and the inner periphery of said annuli of said endplates, said small distance providing inward radial slack in the radial position of said vane in order to provide a purposeful leakage path between said vane tips and said conjugate internal conforming casing profile for said compressed fluid in the event of inadvertently high pressure development inside said machine.

40. The non-contact vane-type fluid displacement machine in accordance with claim 36, wherein the combination of said endplates, rotor, casing, vanes, vane control means, and seal region between said rotor periphery and the internal casing profile, comprises a gas compressor wherein gas chambers are formed within said casing, rotor periphery, two adjacent vanes, and opposing endplates, such that said rotor rotates, said chambers undergo significant volume changes so that when gas enters said machine through an inlet passage, said gas undergoes compression and is discharges through a discharge passage at elevated pressure.

41. A method for determining a conjugate internal conforming profile for a non-contact vane type fluid displacement machine, comprising the steps of (a) setting an initial extended angular location of the vane;

(b) locating coordinates of a pivot pin, Pp, of the vane based upon the vane angle and the radius of a circular vane guide;

(c) computing the corresponding angle from the horizontal axis of the casing to a line from the casing center, $O_s$, and the vane tip radius center Pvtc, based upon vane dimensions and trigonometric functions;

(d) locating the coordinates of the vane tip radius center from the angle found in step (c) and the linear dimensions of the vane;

(e) locating coordinates of a tangency point Pvt based upon the vane tip radius and the angle to the center of the vane tip radius from the casing center; and (f) repeating steps (a) through (e) by incrementing the angular location of the vane by a finite amount to generate a locus of points defining the conjugate internal conforming profile.

* * * * *